US007621425B2

(12) United States Patent
Mathew

(10) Patent No.: US 7,621,425 B2
(45) Date of Patent: Nov. 24, 2009

(54) APPARATUS FOR CONTROLLED INITIATION OF FLUID-FLOW FROM AN INVERTED CONTAINER

(75) Inventor: Shelby Mathew, Fort Lauderdale, FL (US)

(73) Assignee: Genx Innovations, LLC, Fort Lauderdale, FL (US)

( * ) Notice: Subject to any disclaimer, the term of this patent is extended or adjusted under 35 U.S.C. 154(b) by 498 days.

(21) Appl. No.: 11/312,626

(22) Filed: Dec. 20, 2005

(65) Prior Publication Data

US 2007/0246485 A1 Oct. 25, 2007

(51) Int. Cl.
*B65D 37/00* (2006.01)

(52) U.S. Cl. ..... 222/212; 222/541.3; 215/45

(58) Field of Classification Search ..... 222/541.3, 222/491, 498, 556, 213, 517, 494, 212, 541.4, 222/541.6; 215/41, 45, 47, 48, 49, 305, 306, 215/349–351, 363

See application file for complete search history.

(56) References Cited

U.S. PATENT DOCUMENTS 2,077,985 A * 4/1937 Bukolt ..... 215/250
2,904,204 A 9/1959 Naphtal et al.
3,029,987 A * 4/1962 Gronemeyer ..... 222/541.4
3,066,820 A 12/1962 Faulstich
3,473,685 A 10/1969 Karlan
4,098,398 A 7/1978 Meyers
4,488,657 A 12/1984 Deland
4,597,423 A 7/1986 Chenot
4,685,579 A 8/1987 Stapleton
D293,652 S 1/1988 Peters
D293,653 S 1/1988 Peters
4,828,128 A 5/1989 Tackles
4,846,236 A 7/1989 Deruntz
4,865,224 A 9/1989 Streck
4,874,023 A 10/1989 Ulm
4,877,142 A 10/1989 Doering
4,923,085 A 5/1990 Lillelund et al.
4,991,635 A 2/1991 Ulm
5,058,778 A 10/1991 Weinstein
5,121,778 A 6/1992 Baker et al.
5,199,615 A 4/1993 Downing et al.
5,282,540 A 2/1994 Beck
5,392,939 A 2/1995 Hidding et al.
5,413,152 A 5/1995 Burrows
5,425,401 A 6/1995 Boggs
5,472,123 A * 12/1995 Jangaard ..... 222/212

(Continued)

*Primary Examiner*—Lien T Ngo
(74) *Attorney, Agent, or Firm*—Russ Weinzimmer

(57) ABSTRACT

An apparatus is provided for containing a fluid, and for controlling the release and flow of the fluid. The apparatus includes a container having a mouth, a neck with a circumferential sealing region on its inner surface, a body, and a resistance stop. The apparatus further includes a barrier flap which can significantly arc transverse to its length, disposed within the neck of the container, and hingedly pivot between "open" and "closed" positions. The barrier flap is cooperative with the circumferential sealing region and the resistance stop within the neck. Squeezing the body increases internal pressure within the container, resulting in a release of the barrier flap past the resistance stop, allowing the fluid to flow out of the container. Also, squeezing the neck causes arcing and release of the barrier flap, allowing the fluid held in the container to flow past the barrier flap and out of the container.

19 Claims, 36 Drawing Sheets

U.S. PATENT DOCUMENTS 5,542,555 A 8/1996 Hidding et al.
5,603,436 A 2/1997 Leoncavallo et al.
5,605,257 A 2/1997 Beard
5,634,502 A 6/1997 Pierce
5,636,772 A * 6/1997 Poulsen ..... 222/541.6
5,667,107 A 9/1997 Lindsey
5,868,287 A 2/1999 Kurokawa et al.
5,904,259 A 5/1999 Hidding et al.
5,947,344 A * 9/1999 Jangaard ..... 222/494
5,957,316 A 9/1999 Hidding et al.
6,068,032 A 5/2000 Milner
6,186,367 B1 2/2001 Harrold
6,206,251 B1 3/2001 Williams
6,250,568 B1 6/2001 Prueter
6,267,304 B1 7/2001 Schultz
6,330,960 B1 12/2001 Faughey et al.
6,341,718 B1 1/2002 Schilthuizen et al.
6,394,315 B1 5/2002 Banks
6,398,133 B1 6/2002 Schultz
6,402,054 B1 6/2002 Prueter et al.
6,766,922 B2 7/2004 da Silva
D499,647 S 12/2004 Wills
D528,423 S 9/2006 Glover
D536,481 S 2/2007 Angeletta
7,237,698 B2 * 7/2007 Jackman ..... 222/541.4

* cited by examiner

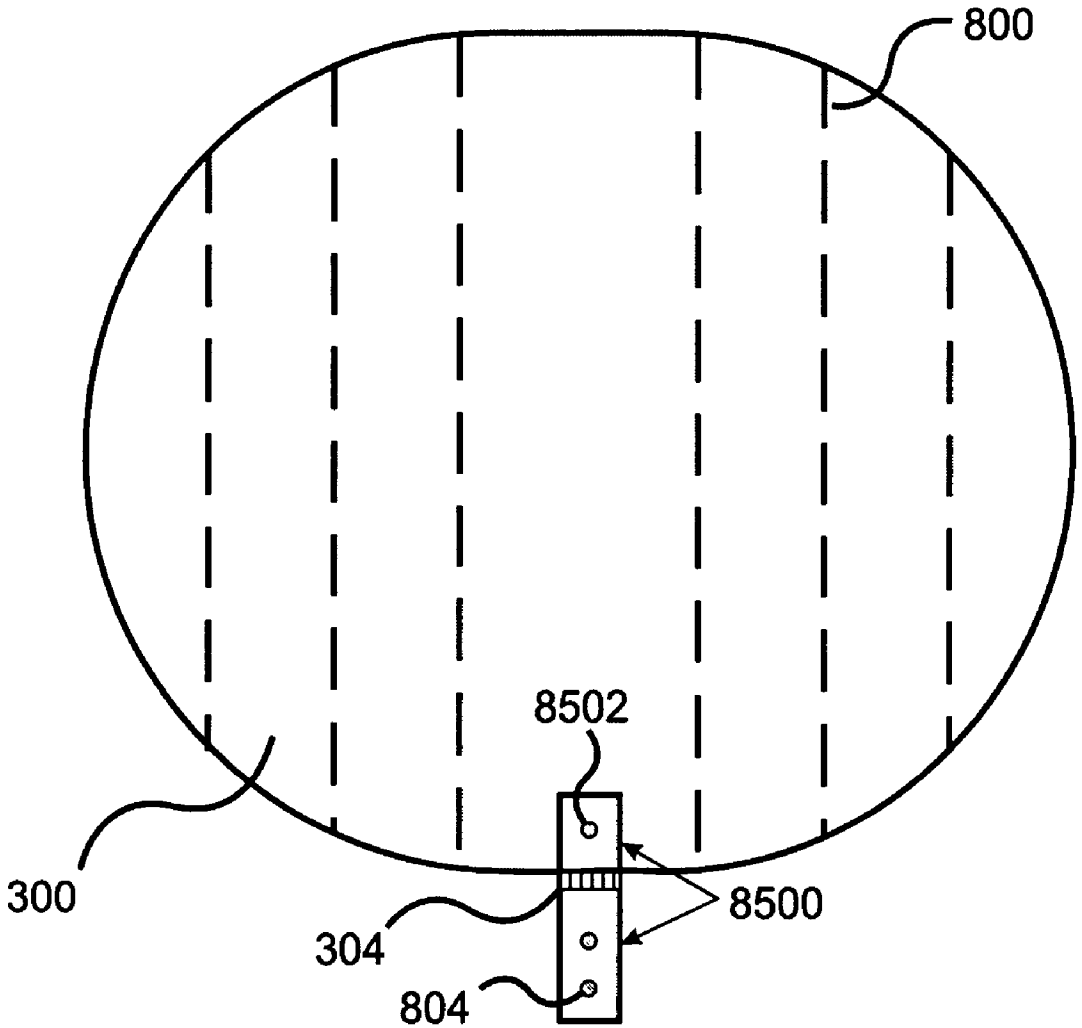
FIG 8.5

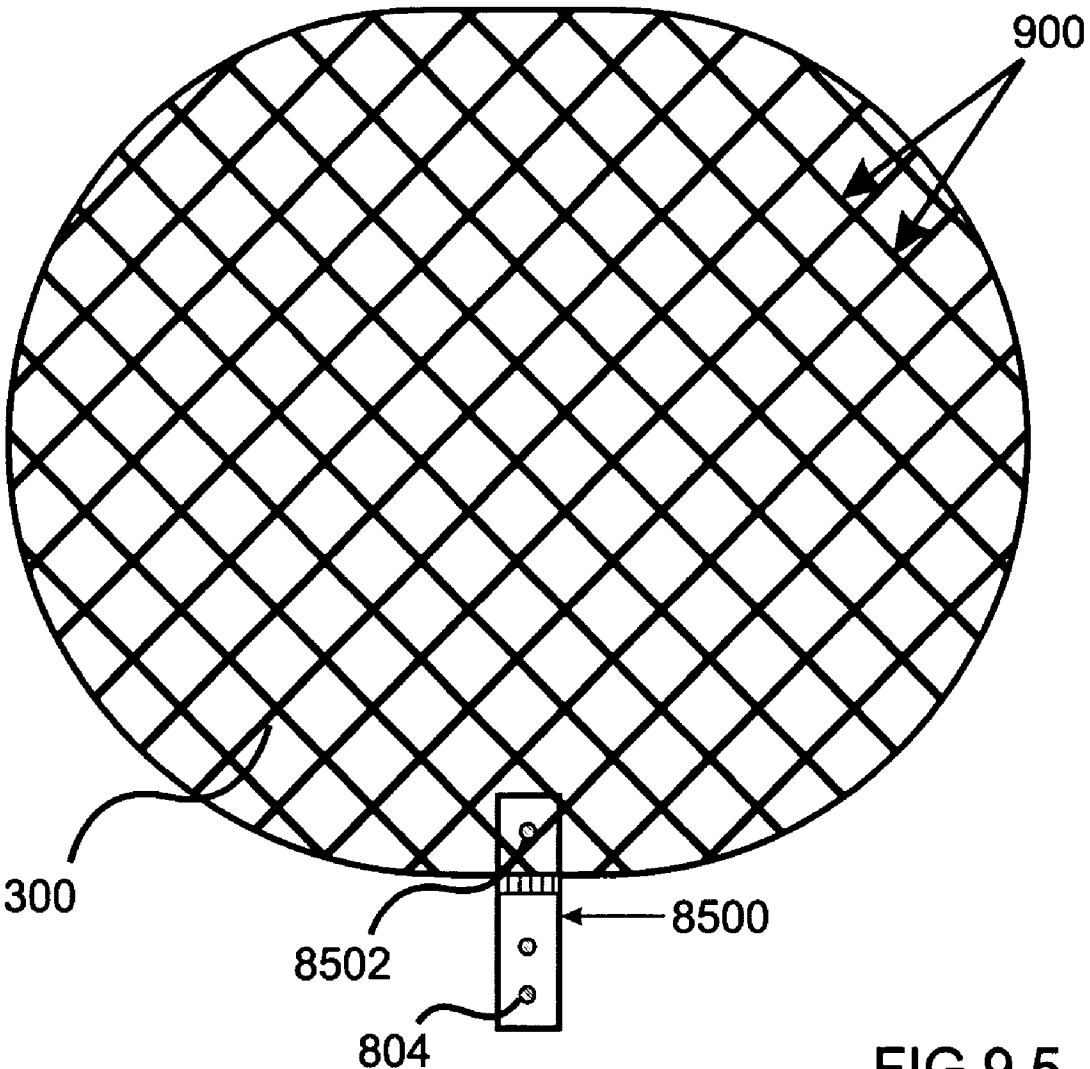
FIG 9.5

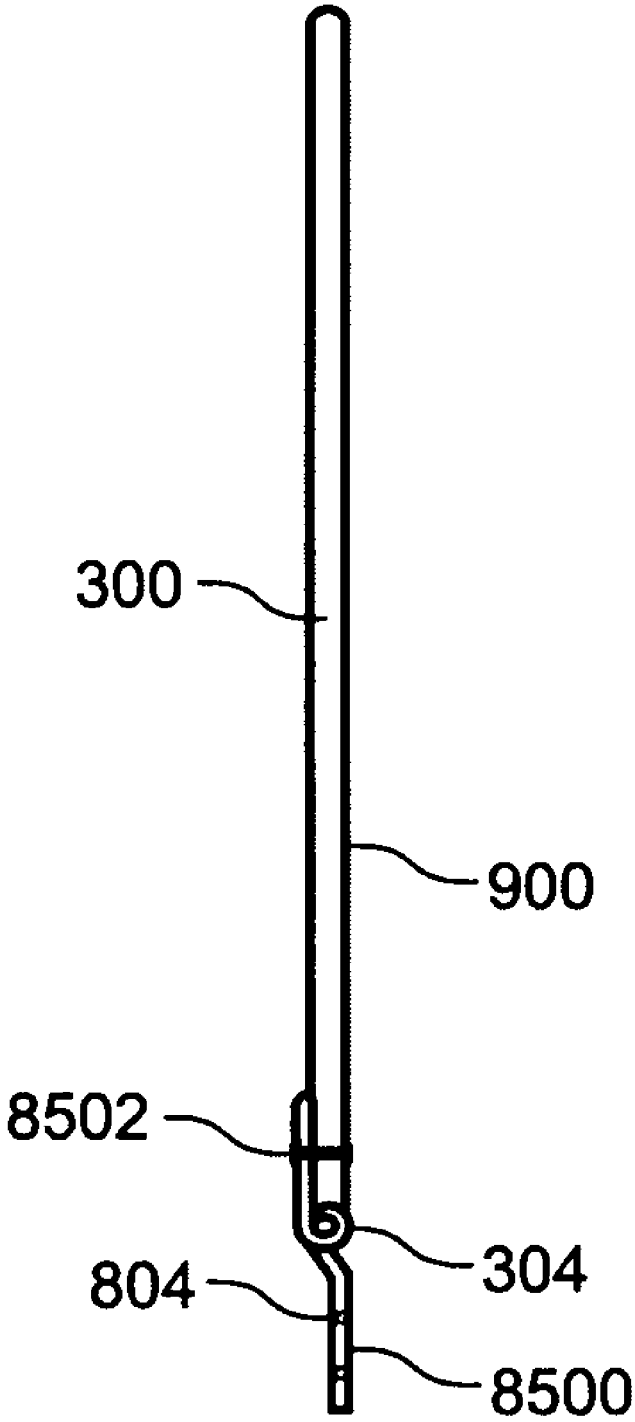
FIG 10.5

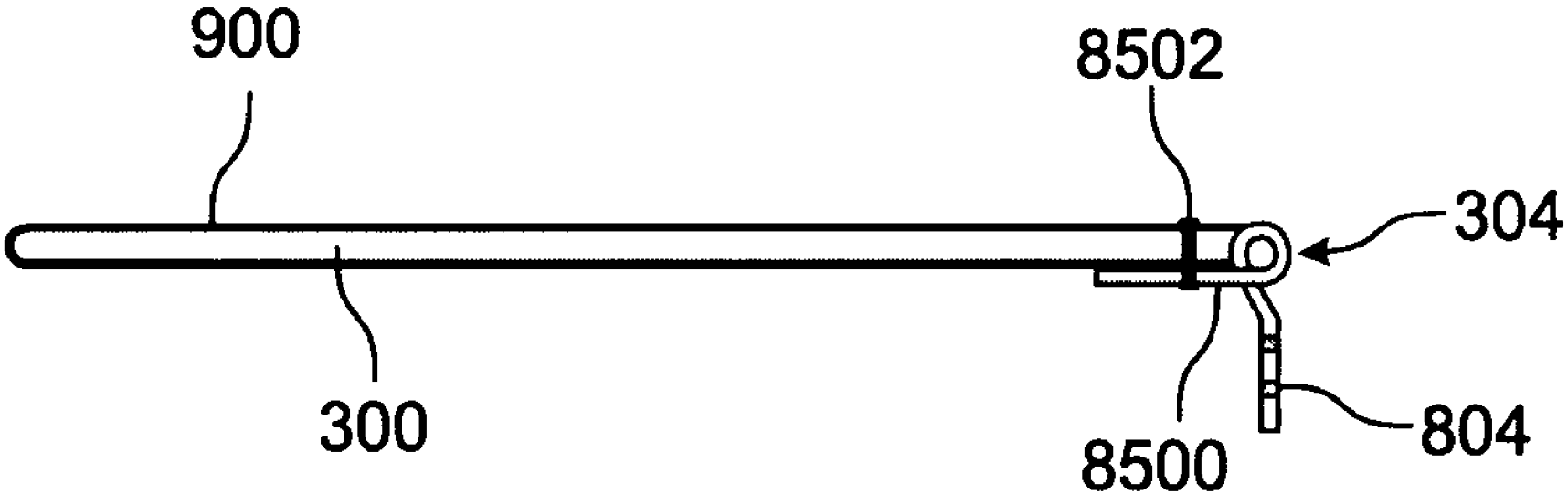
FIG 11.5

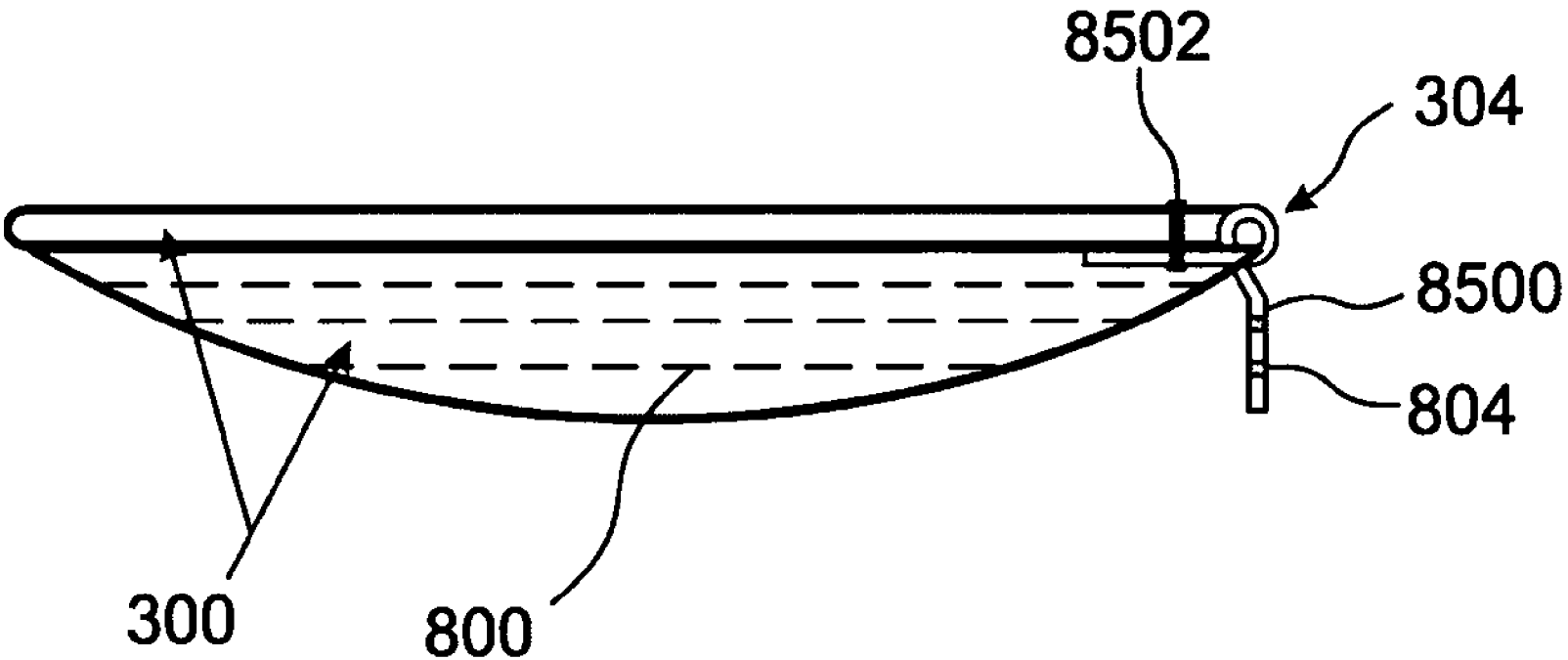
FIG 12.5

APPARATUS FOR CONTROLLED INITIATION OF FLUID-FLOW FROM AN INVERTED CONTAINER

FIELD OF THE INVENTION

This invention relates to vessels for containing fluids, and particularly to a container for facilitating controled release and flow of fluid therefrom.

BACKGROUND OF THE INVENTION

There are many fluids on the market today that must be accurately and carefully poured into a small opening without spilling any of the fluid during the process of pouring it. Often, the fluid is toxic, difficult to clean, costly, or some combination thereof.

Motor oil is a fluid that frequently is poured and inadvertently spilled, creating an undesirable situation. Motor oil is commonly sold in plastic bottles that are typically available in two sizes: one-quart and one-gallon containers. When the motor oil contained therein is poured into the small opening leading into the oil case of an engine, a separate funnel (disposable or non-disposable) is often required to direct the poured oil into the small opening of the oil case. The assistance of a funnel is used to avoid messy and difficult-to-clean spills on and around the engine. However, many times a funnel is not conveniently located nearby for use when pouring the oil. Without a funnel, successfully directing all of the oil poured from a motor oil container into the small opening of the engine oil case can be difficult and challenging for many people.

In addition to fouling the engine area with oil and oil residues, the hand of the person pouring the oil can also become contaminated with oil. The spillage on the engine is cumbersome and time consuming to clean, as well as being harmful to the environment. And even with the use of an oil funnel, spills can occur on the engine immediately when the funnel is withdrawn from the oil case prematurely. Also, non-disposable funnels need to be carried and stored carefully and appropriately, but many times the funnel is simply placed on a dusty shop floor or in a similarly open, dirty contaminated holding area.

Office water coolers provide another example of a common pouring problem from an inverted container. Water bottles typically are delivered for use with a dispenser that requires that the water bottle first be opened, and then inverted prior to resting on top of the dispenser. However, the bottle is very large, and a large volume of water is heavy. During the process of lifting and inverting the bottle, the water begins to pour out of the bottle and onto the floor, even before the open mouth of the bottle is inserted within the top of the dispenser. The water that escapes the bottle typically falls on the floor around the dispenser, leaving a puddle that must be removed to avoid causing a possible slip-and-fall accident.

SUMMARY OF THE INVENTION

In one general aspect, the invention includes a container, which when inverted, can be controllably inserted into an opening, such as the oil crankcase of an engine or the like, and then squeezed, at will, to release the contents of the container into the crankcase opening. In one case, a squeezing action applied to the main body of the container increases the container's internal pressure, resulting in the release of a closed barrier flap, thereby allowing the fluid contents to flow out. The invention thereby eliminates all of the above-mentioned problems that are associated with pouring a fluid, such as motor oil or spring water, without the use of a funnel. In an alternate case, a squeezing action is applied to the neck of the container, thereby causing direct arcing compression of the barrier flap disposed within the neck. The compression applied upon the neck wall urges the barrier flap past the resistance stop and into an open position, thereby allowing the fluid held in the container to flow past the barrier flap and out of the container.

The container of the invention is especially useful for facilitating controlled release and pouring of liquids stored in a container that are poured by inversion, such as automotive fluids, including motor oil, windshield washer fluid, break fluid, transmission fluid, as well as fluids in other environments, such as natural spring water bottles for use with water coolers.

For example, the container of the invention allows a user to pour oil directly into an engine's oil case without the need of a separate funnel. It is this ease of use that enables people whom would not ordinarily attempt to replace fluids in an automotive or office environment to successfully accomplish this otherwise difficult and messy task. The "do-it-yourself" person will find added convenience and simplicity. There is no mess before, during, or after the pouring action. In addition, there is no direct inadvertent contact of the user with the poured contents of the container. The user can also more easily control the release timing and quantity of liquid flow from the container. The invention can be operated with only one hand, further demonstrating the convenience of operating the invention, in contrast with the use of a standard container aided by a separate funnel typically requiring at least two hands.

The invention is advantageously pre-filled with a hard-to-pour liquid that must be carefully controlled during pouring, such as motor oil, and sold to the consumer for personal use; or sold to the professional, such as an auto mechanic, for professional use. The consumer will benefit by being relieved of the need for a funnel, and being spared the fear of contacting oil, or of causing a mess. An auto mechanic will benefit from the invention by avoiding the need to spend extra time and energy using and storing a contaminated funnel, and by avoiding the need to clean a possible spillage of oil after it's poured.

An important advantage to a manufacturer of the invention is its low cost of manufacturability, and its simple structural design, thereby minimizing required manufacturing steps and minimizing procurement of additional materials beyond that of a standard motor oil bottle.

Further, the value added by this invention will benefit a company by increasing the value of its brand by association with the invention. Consumers will associate the container's ease-of-use, avoidance of mess, and added convenience with products packaged within the container. These benefits will enable a company that incorporates the container to create an innovative marketing strategy capable of capturing new market share from competitors.

As recognized by the invention, the container of the invention does not need an additional funnel inside the bottle because the standard motor oil bottle already has a built-in funnel included in its molded shape. Also unlike other container types, there is no need to pull out an internal funnel or twist any rotary part of the bottle to release fluid therefrom. Moreover, after the container is opened, such as by removing a seal or cap, there is no need to touch anything inside the container to commence pouring. Also, the user does not need to touch anything having liquid residue after the previously contained liquid has been poured.

The container of the invention allows a user to avoid having any contact with the contents of the container, while providing independent control over both inversion of the container, and release of the fluid contained therein.

In one general aspect, the invention provides an apparatus for containing a fluid, and for controlling the release timing and flow of the fluid contained therein. The apparatus includes a container having a mouth, a neck, and a body, an inner surface of the neck including a circumferential sealing region, and a resistance stop. The apparatus further includes a barrier flap that can substantially arc and hingedly pivot, which is disposed within the neck of the container. This barrier flap functions in conjunction with the circumferential sealing region and the resistance stop.

In a preferred embodiment, the circumferential sealing region includes a circumferential sealing ridge. In another preferred embodiment, an edge of the moveable substantially flexible flap is capable of being in sealed relationship with the circumferential sealing region.

In a further preferred embodiment, the flap is hingedly connected to an inner wall of the container's neck. In an alternate preferred embodiment, the flap is pivotally connected to an inner wall of the neck of the container. In yet another embodiment, the flap is arcuate.

In another preferred embodiment, an edge of the barrier flap is in sealed relationship with an inner wall of the neck of the container when the barrier flap is in a closed position. In a further preferred embodiment, the inner wall of the neck of the container includes the circumferential ridge, and the edge of the barrier flap is engaged as a seal together with the circumferential ridge when the barrier flap is in the "closed" position.

In a preferred embodiment, the barrier flap includes optional longitudinal grooves running parallel to a longitudinal bending axis of the barrier flap, the grooves being for facilitating arcing of the barrier flap, the longitudinal axis being perpendicular to a transverse opening axis. In an alternate preferred embodiment, the barrier flap includes longitudinal bending regions running parallel to a longitudinal bending axis of the barrier flap, the grooves being for facilitating arcing of the barrier flap, the longitudinal axis being perpendicular to a transverse opening axis. In a further preferred embodiment, the longitudinal bending regions are of a different material than other regions of the barrier flap.

In yet another preferred embodiment, the barrier flap is maintained in a closed position by the resistance stop. In a further preferred embodiment, the barrier flap is maintained in a closed position by the resistance stop, the resistance stop being cooperative with the circumferential sealing region.

In other embodiments, the apparatus further includes a guard, disposed between the neck and the mouth of the container, and shaped so as to prevent the barrier flap from exiting with the fluid out of the container in the event that the barrier flap becomes detached from the inner neck wall of the container. In a preferred embodiment, the guard spans the mouth of the container.

In various other embodiments, the mouth is narrowed so as to prevent the barrier flap from exiting with the fluid out of the container in the event that the barrier flap becomes detached from the inner neck wall of the container.

In other preferred embodiments, the neck of the container is squeezable. In additional preferred embodiments, the body of the container is squeezable.

In another general aspect of the invention, an apparatus for containing a fluid, and for controlling the release and flow of the fluid contained therein, includes a container having a mouth, a neck, and a body; as well as a valve, disposed within the neck of the container. The valve includes a circumferential sealing element cooperative with an inner wall of the neck, a resistance stop cooperative with an inner wall of the neck, and a moveable substantially arcable barrier flap, cooperative with the circumferential sealing element and the resistance stop, so as to prevent the release and flow of the fluid contained therein when the barrier flap is in a "closed" position.

BRIEF DESCRIPTION OF THE DRAWINGS

The invention will be more fully understood by reference to the detailed description, in conjunction with the following figures, wherein:

FIG. 8.5. is a side view of the barrier flap showing it in a flat and un-arced configuration, here also including a "spring-like" hinge in the "open" position;

FIG. 9.5. is a side view of the barrier flap showing it in a flat and un-arced configuration, also showing the protective film covering the barrier flap, and the "spring-like" hinge in the "open" position;

FIG. 10.5 is a front view of the barrier flap showing it in an un-arced and "open" position, the barrier flap also having a "spring-like" hinge;

FIG. 11.5. is a front view of the barrier flap showing it in an un-arced and "closed" position, the barrier flap also having a "spring-like" hinge;

FIG. 12.5. is a front view of the barrier flap showing it in a "closed" position as it would be inside a container, the barrier flap also having a "spring-like" hinge;

DETAILED DESCRIPTION OF PREFERRED EMBODIMENTS

Figure 1:
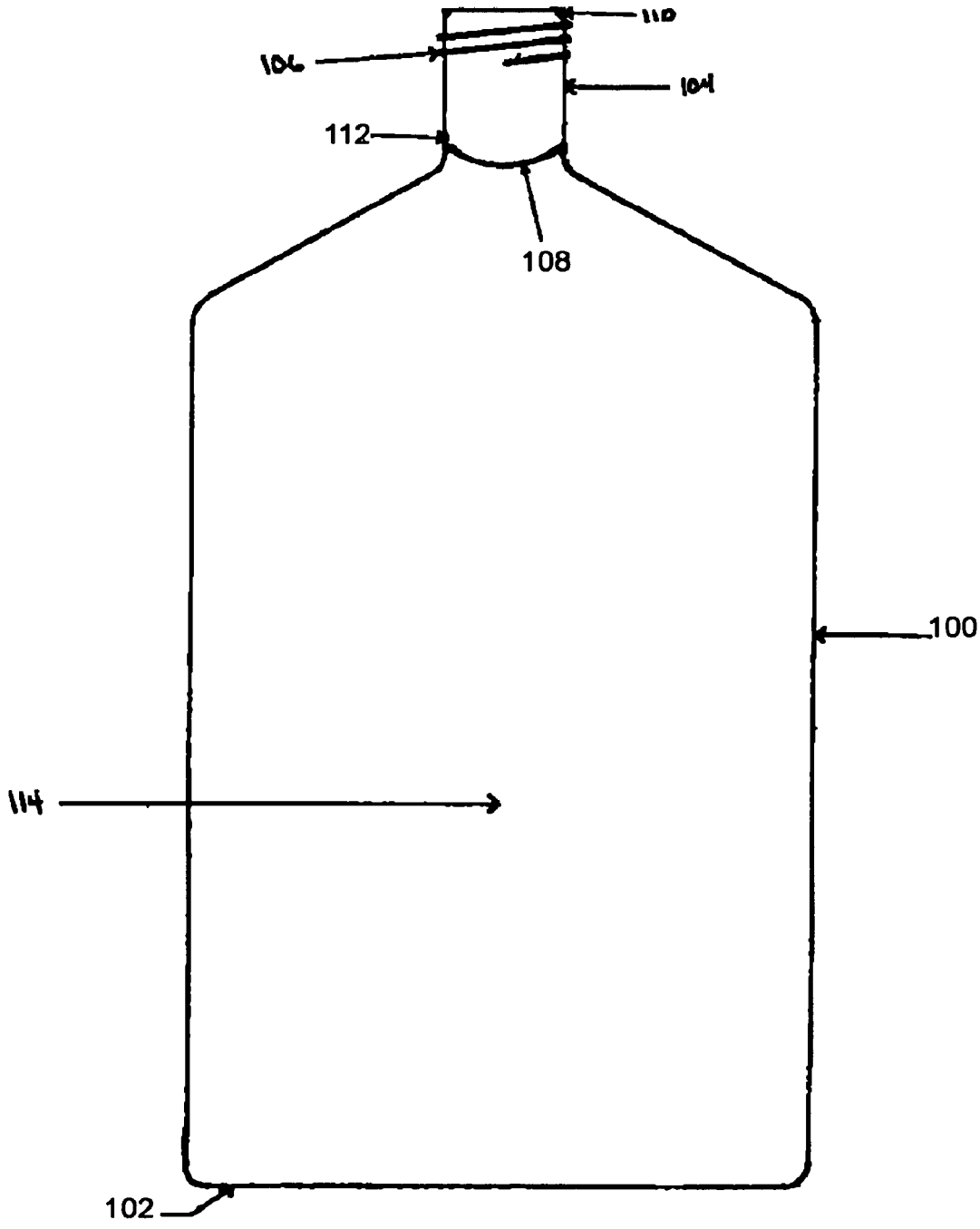
FIG. 1. is a front view of a container having a neck with an inner circumferential sealing region which encircles the inner circumference of the neck.

With reference to FIG. 1, a front view of a typical bottle-like container 100 is shown with a base 102, a neck 104, a mouth 116, and a body area 114. This container 100 also includes optional threads 106 around the outer neck circumference of the container's body to aid in sealing the container closed with a cap or other device. FIG. 1 also shows an indented opening 110 at the mouth of the container 100. A circumferential sealing region 108 and a resistance stop 112 are also contained within the neck of the container.

Figure 2:
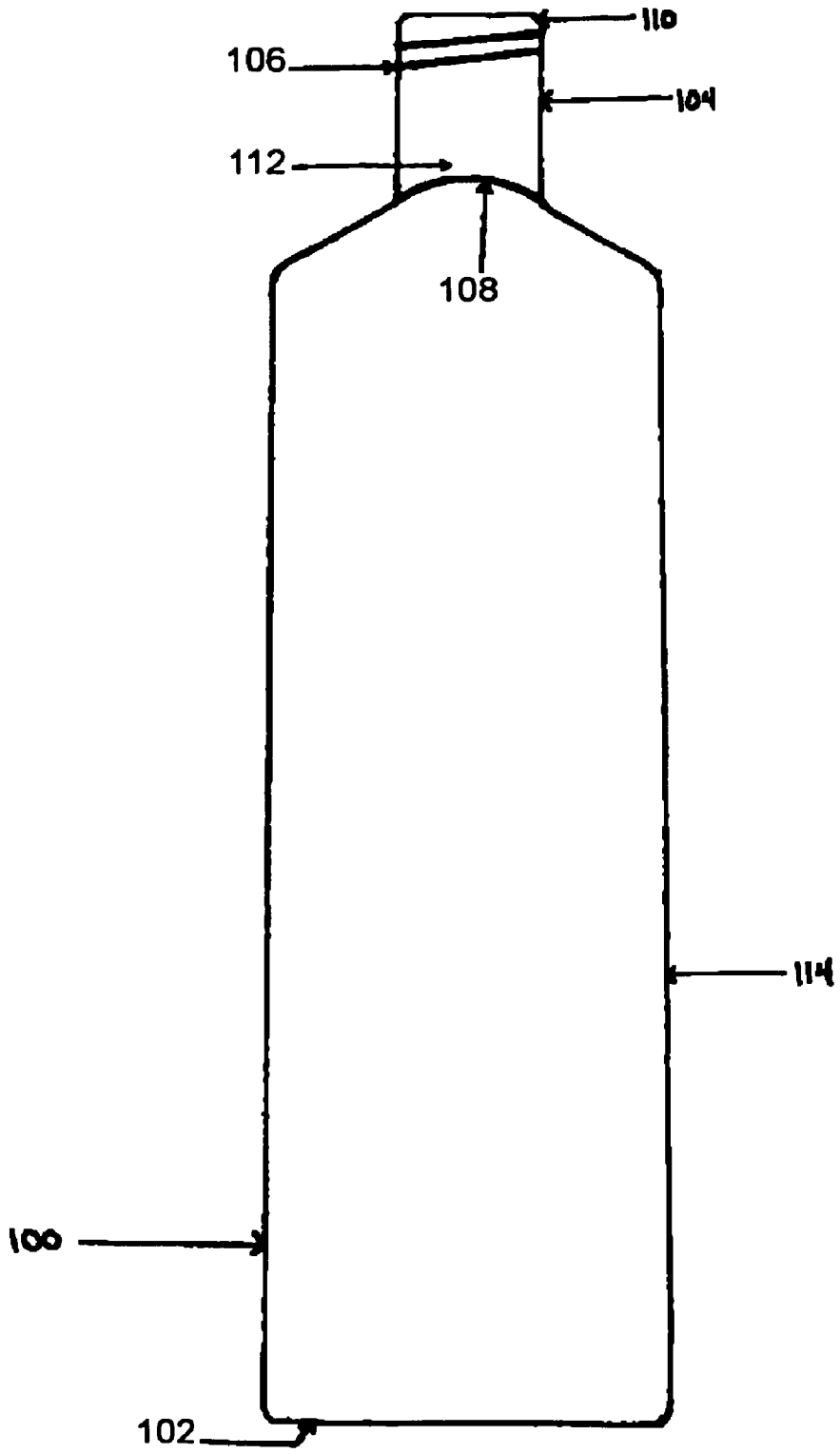
FIG. 2. is a side view of a container showing the inner circumferential sealing region which encircles the inner circumference of the container's neck.

FIG. 2 is a side view of a typical bottle-like container 100, showing the base 102, the neck 104, the mouth 116, and the body area 114. This container also shows, similar to FIG. 1, optional threads 106 around the outer neck circumference of the container's body and an indented opening 110 near the mouth 116 of the container. FIG. 2 also includes a circumferential sealing region 108 and resistance stop 112 contained within the neck of the container.

Figure 3:
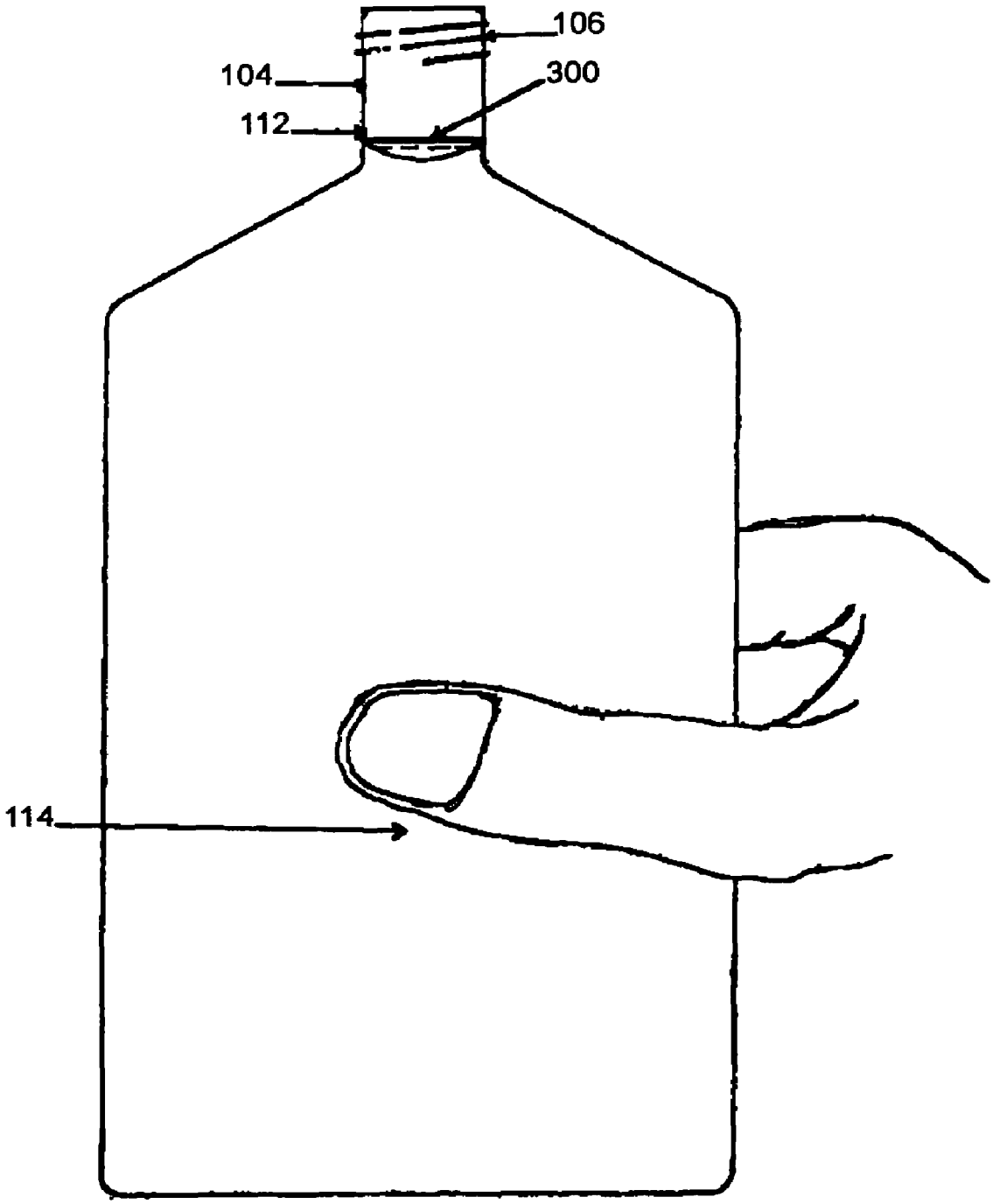
FIG. 3. is a front view of the container of FIG. 1 showing a barrier flap, and a hand in position to squeeze the body of the container, wherein the barrier flap is in the "closed" position.
Figure 17:
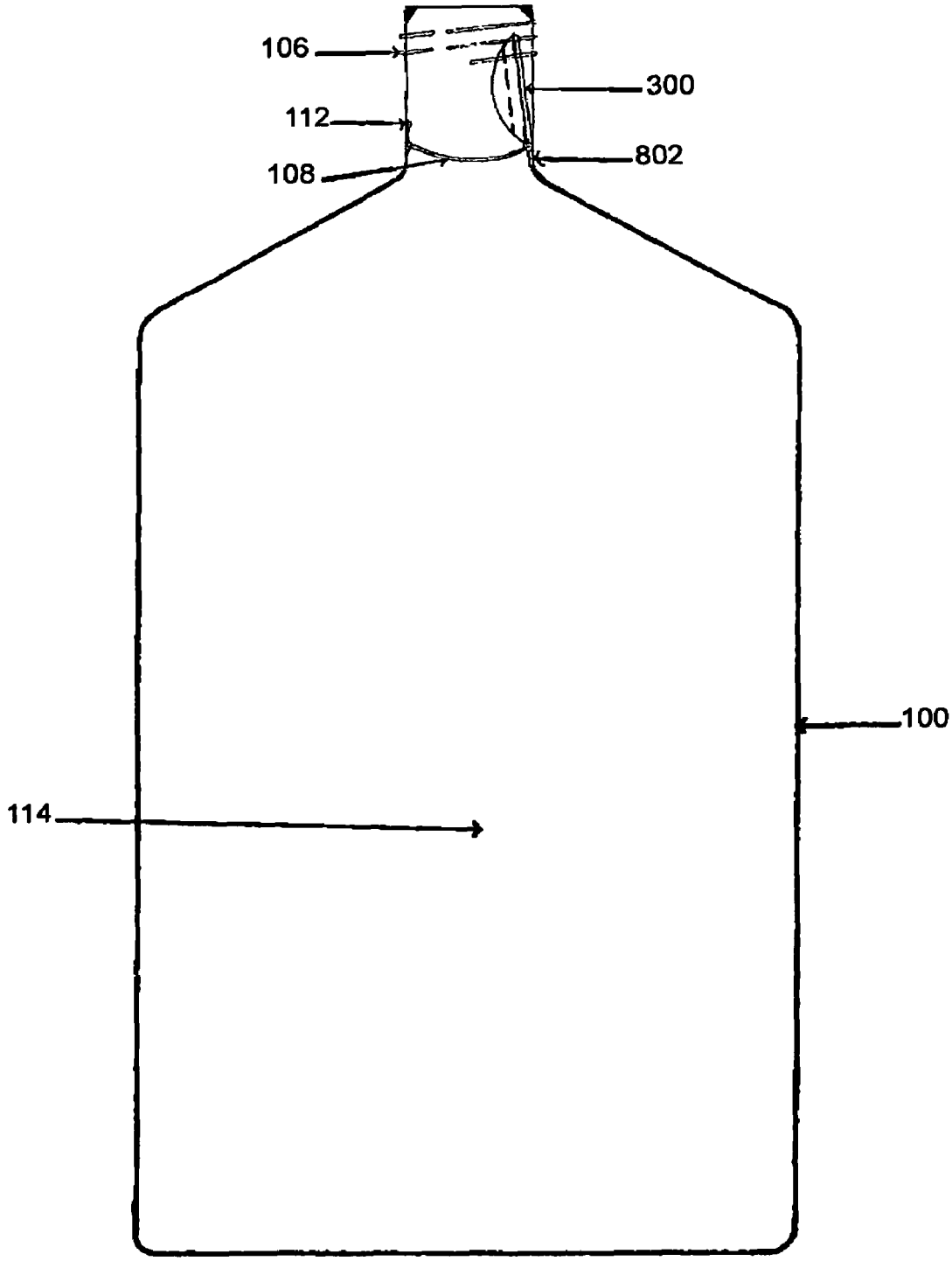
FIG. 17. is a front view of a container showing the barrier flap in its arced and "open" position.

FIG. 3 is a front view showing an upright bottle-like container 100 showing hand placement 302 on the front body area 114 of the container. This body area 114 has a flexible wall and can be substantially squeezed to increase pressure within the container. A barrier flap 300 that has the ability to arc, and to hinge "open" and "closed" along its hinging region 304 is shown in its "closed" position within the neck 104 of the container. The natural unstressed state and inherent disposition of the barrier flap 300 is to be in the "open" position, such as shown in FIG. 17. But without substantial squeezing of the container, the barrier flap 300 is prevented from moving into the "open" position due to being blocked by the resistance stop 112. The unnatural, stressed state of the barrier flap is to be in the "closed" position. In this "closed" position in FIG. 3, the barrier flap 300, together with the circumferential sealing region 108 within the inner neck wall 104 of the container, forms a circumferential seal to prevent any fluid or gas from being exchanged between the outside and inside of the container. In FIG. 3, although the container 100 is being held upright with the hand, the container's body area is not yet being significantly squeezed.

Figure 4:
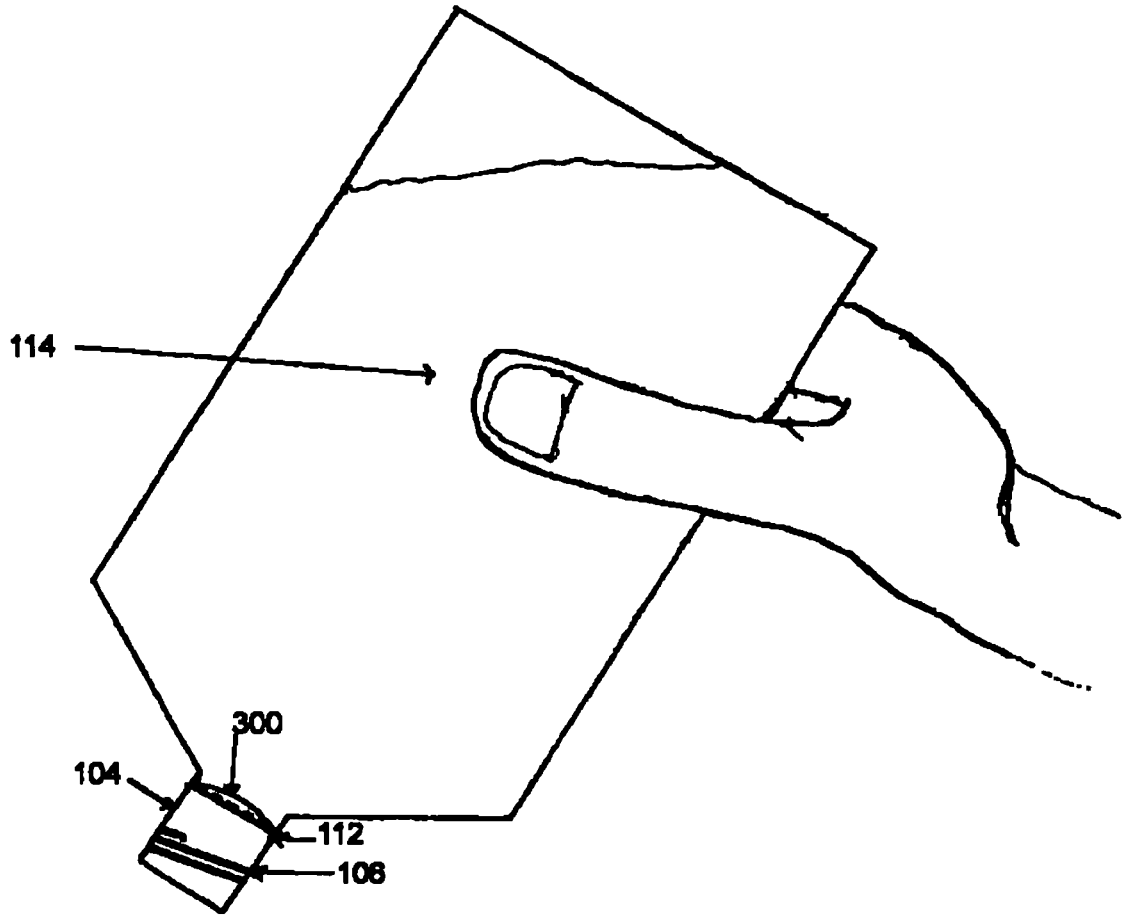
FIG. 4. is a front view of an inverted container showing a barrier flap in the "closed" position, and the hand in position to squeeze the bottle.

FIG. 4 shows an inverted bottle-like container 100 being held in the body area 114 by a hand 302. The barrier flap 300 that can arc and hinge remains in the "closed" position, forming a circumferential seal around the inner circumference of the neck. Although the container 100 is being held inverted by the hand 302, the body area 114 is not yet being significantly squeezed. With the barrier flap in the "closed" position and the circumferential seal engaged, any fluid or gas exchange between the inside and outside of the container is prevented.

Figure 5:
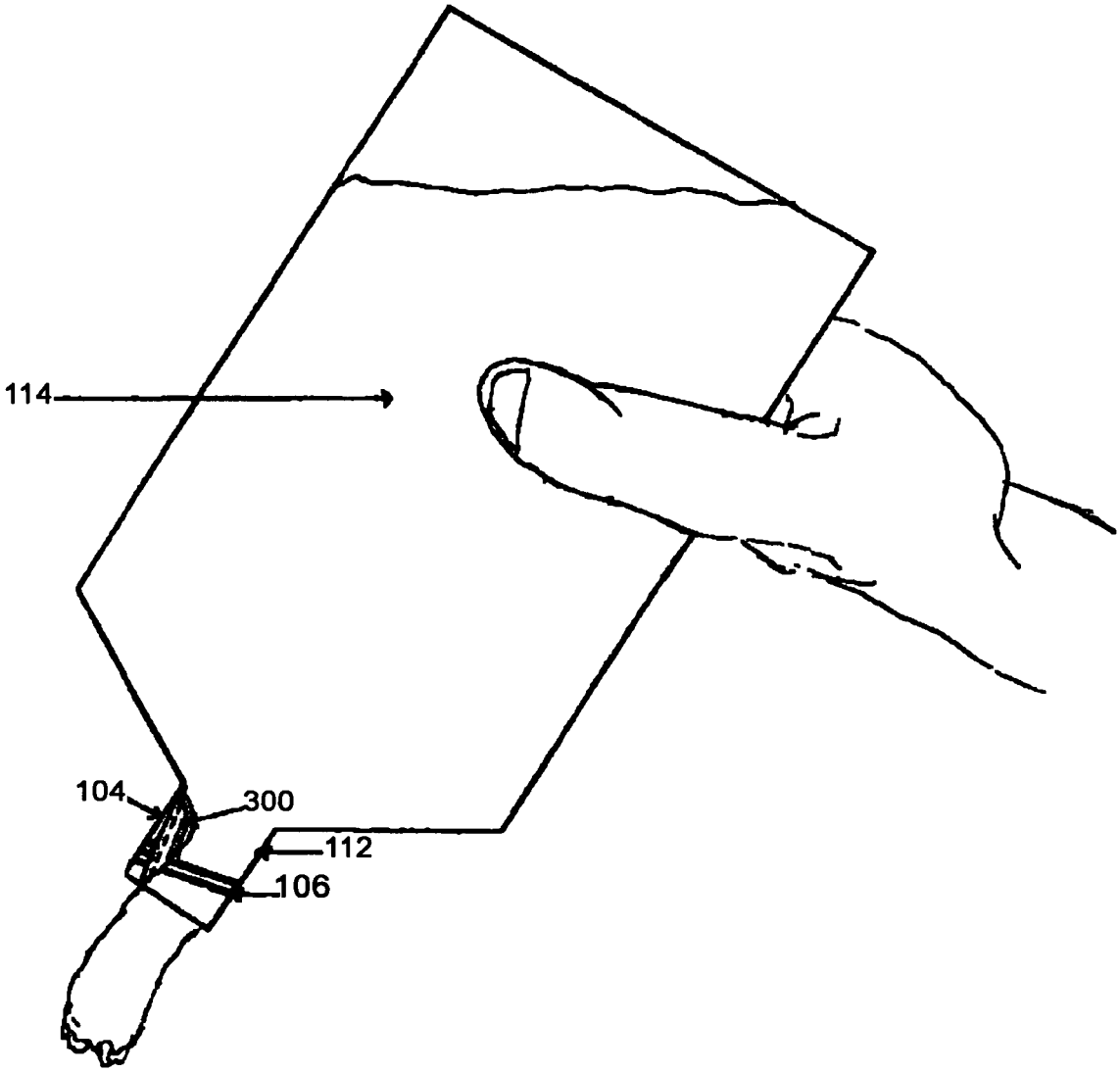
FIG. 5. is a front view of an inverted container showing the barrier flap in the "open" position, and the hand holding the container after squeezing the body of the bottle so as to commence fluid flow.

FIG. 5 shows an inverted container 100 that is being squeezed at the container's body area 114 by the hand 302. While the container's body area 114 is being squeezed, internal container pressure significantly increases, exerting force on the barrier flap 300. This internal pressure causes the barrier flap 300 to exert increased force against the resistance stop 112. As the container continues to be squeezed, the internal container pressure continues to build until the pressure causes the barrier flap 300 to overcome the obstructive force of the resistance stop 112. When the barrier flap 300 overcomes the obstructive force of the resistance stop, the barrier flap hinges to the "open" position. Simultaneously, the barrier flap's movement away from the circumferential sealing region 108 causes the circumferential seal to break and become disengaged. The barrier flap continues to move towards its "open" position about its hinging region 304 until it comes to rest along the inner neck wall 104. After the container is inverted and once the circumferential seal is disengaged, gravitational forces along with internal container pressure causes fluid 500 from the container to flow out of the container's mouth 116.

Figure 6:
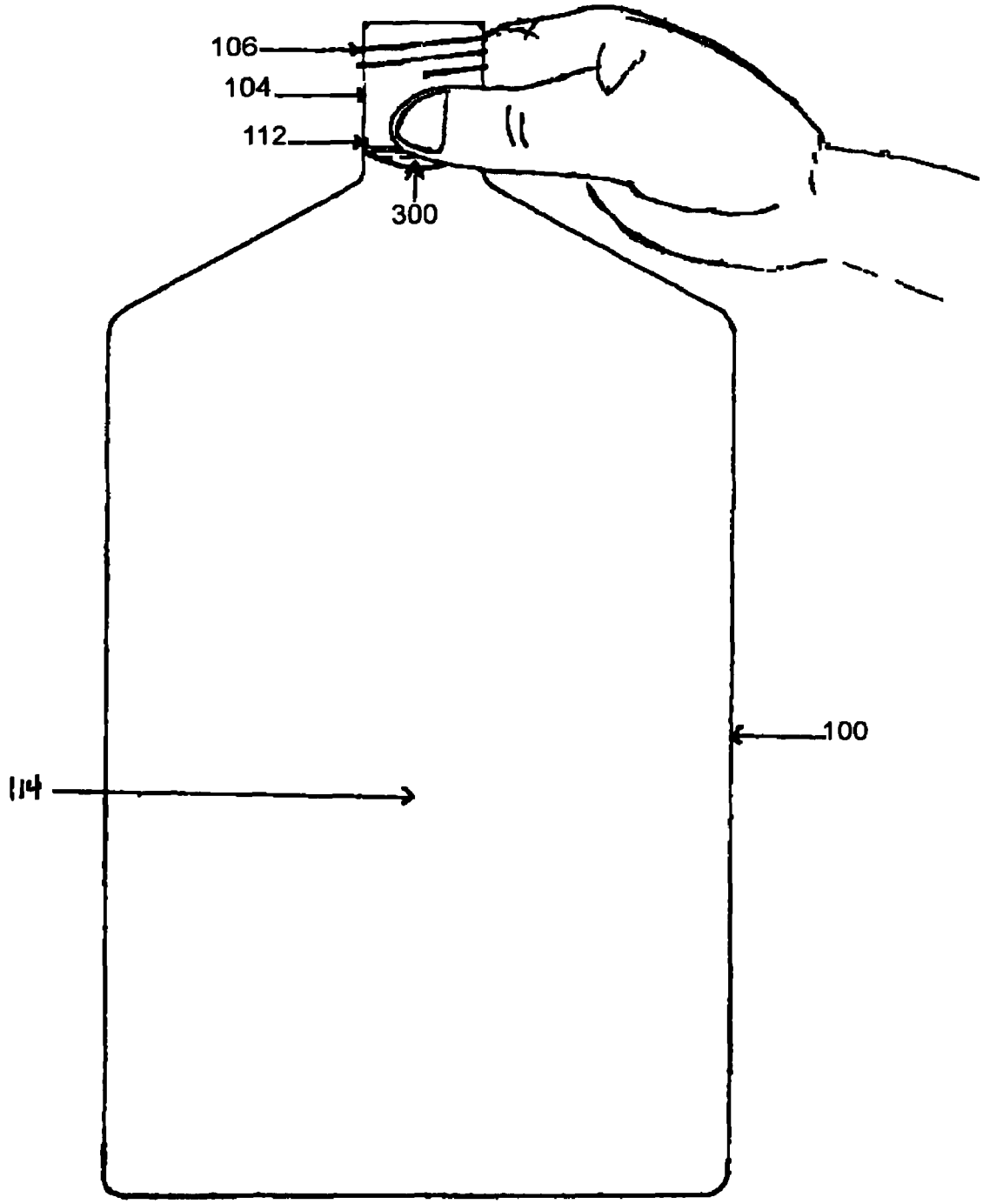
FIG. 6. is a front view of the container showing the barrier flap in the "closed" position, and the hand in position to squeeze the neck of the container so as to urge the barrier flap into the "open" position.

FIG. 6 shows the front view of a container 100 in its upright position. This figure shows hand positioning to open the container's barrier flap 300 through a second "neck squeezing" method. The hand 302 depicted in the figure is placed on the neck region 104 of the container. The barrier flap 300 is in the "closed" position forming a circumferential seal along the inner circumference of the container's neck. The neck 104 of the container is semi-rigid yet flexible for squeezing. When the neck region has applied force squeezing it, the barrier flap 300 begins to substantially arc from the inward flexing of the neck wall. This squeezing pressure causes the barrier flap to arc and for the container's mouth to temporary change shape.

Figure 23:
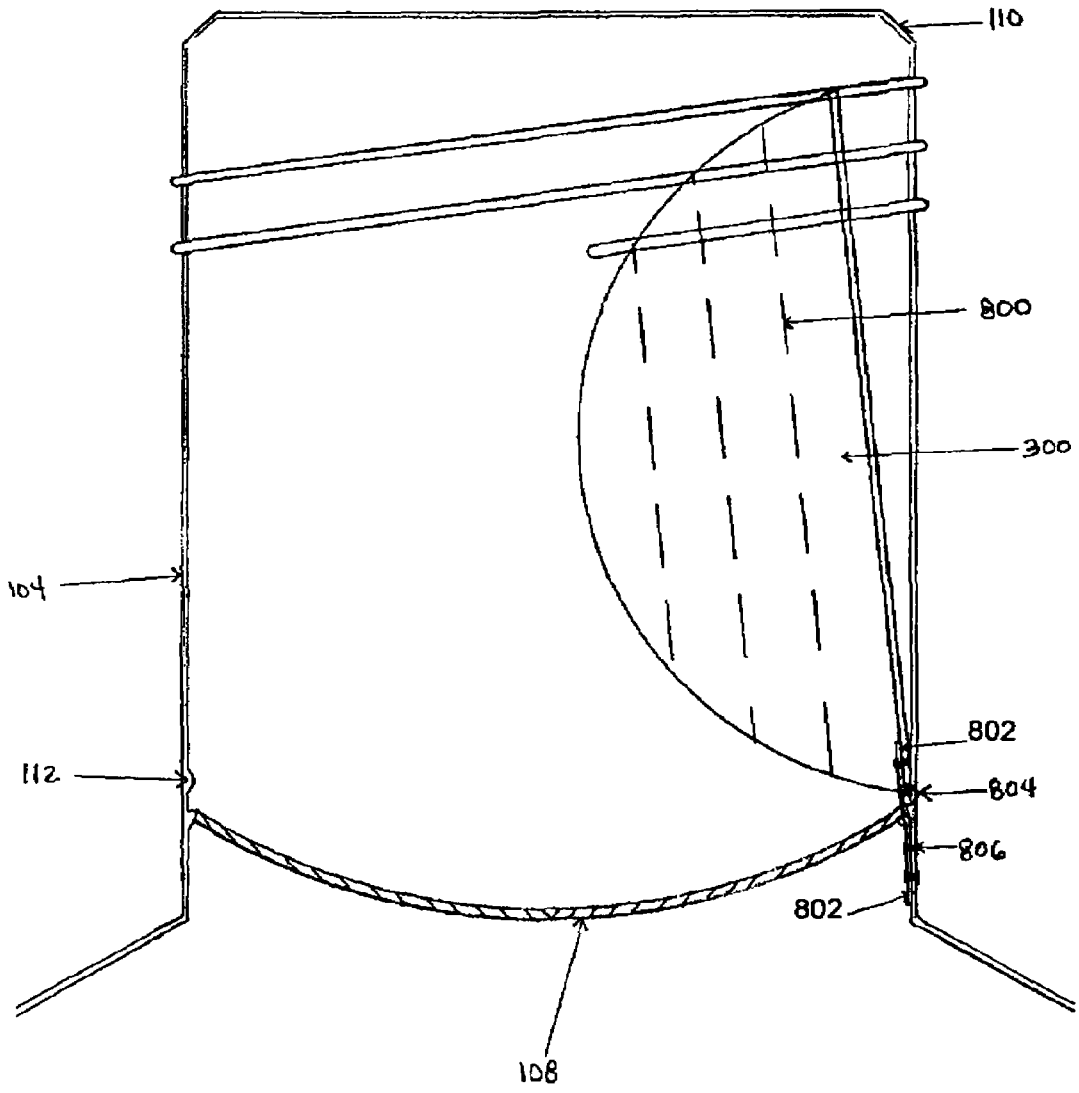
FIG. 23. is a close-up front view showing the barrier flap showing it in its substantially arced and "open" position.
Figure 28:
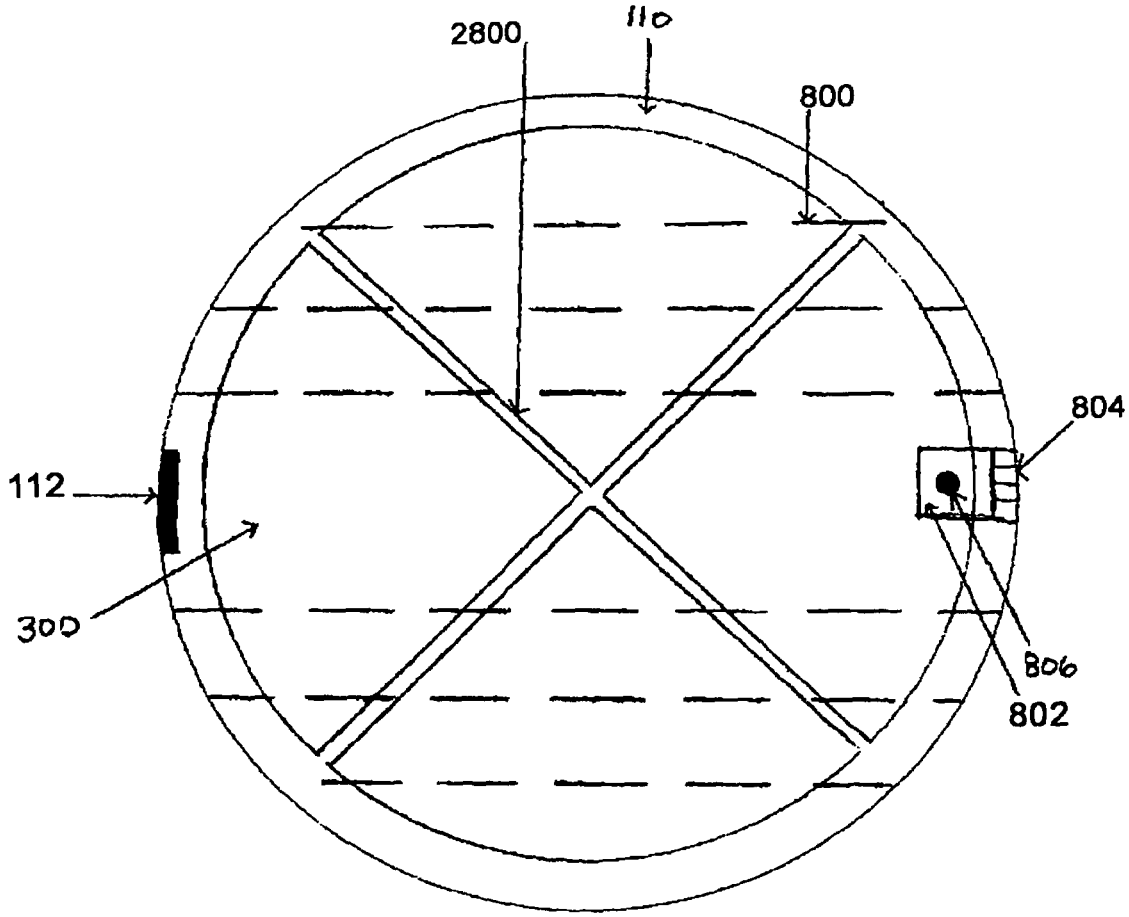
FIG. 28. is a top view of the container's mouth and neck, showing the barrier flap attached in place, slightly arced and "closed", also showing a safety guard, and the grooves of the barrier flap that facilitate arcing of the barrier flap.
Figure 29:
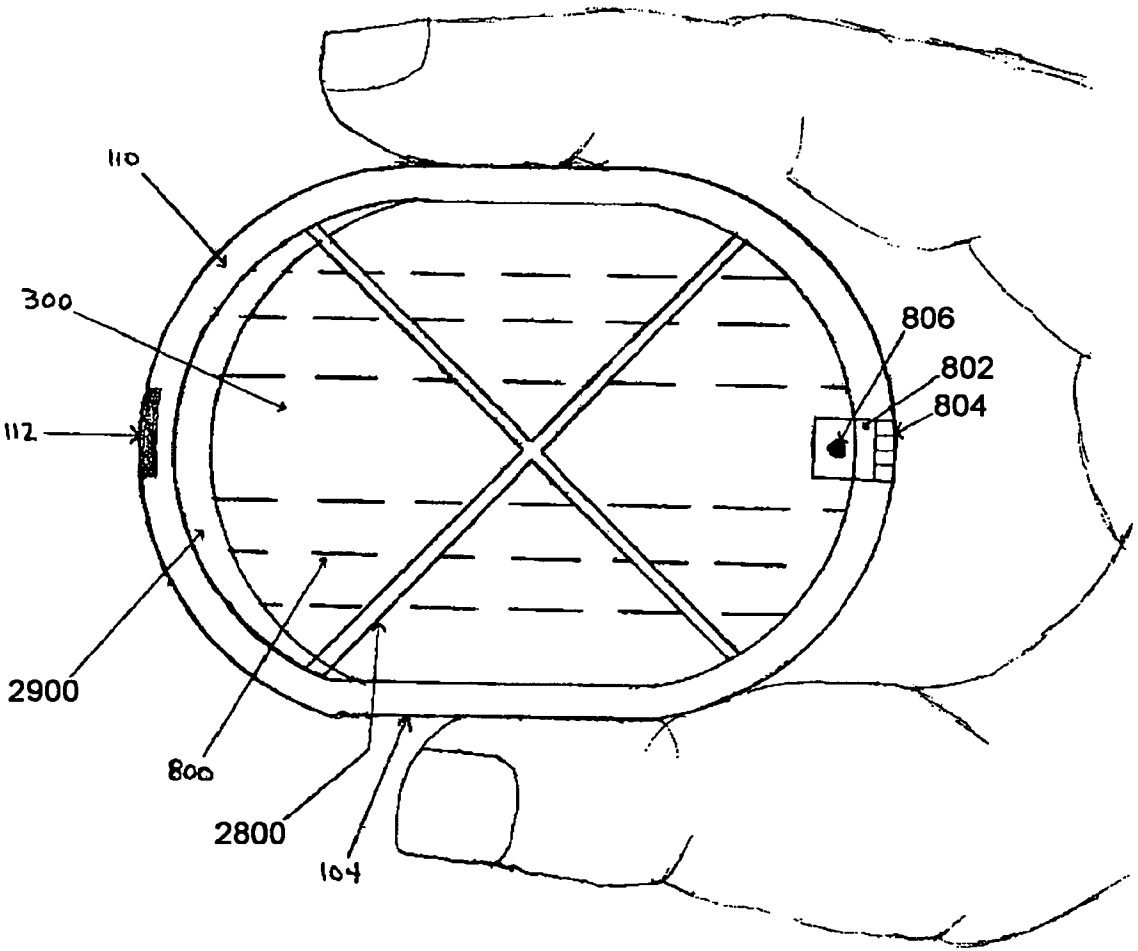
FIG. 29. is a top view of the mouth and neck showing the neck being squeezed, while the barrier flap is still in the "closed" position, but has just overcome the resistance stop that will allow the barrier flap to move into the "open" position.

From a top view, the mouth's shape changes shape temporarily, as shown in FIG. 29, allowing the barrier flap 300 to overcome the obstructive force from the resistance stop 112. Once the barrier flap 300 overcomes the obstructive force from the resistance stop, it continues to hinge "open" about its hinging region 304 until the barrier flap 300 ultimately rests up against the inner neck wall, as shown in FIG. 23. As mentioned above, as the neck is squeezed, its circular shape (from a top view as shown in FIG. 28), becomes elongated into a temporary oval shape causing the resistance stop 112 to move away from the barrier flap, such as in FIG. 29. When the resistance stop 112 moves away from the barrier flap due to the neck's new temporary shape, the resistance stop 112 reduces its obstructive force on the barrier flap 300 allowing it to hinge open, as shown in FIG. 23. When the barrier flap 300 hinges open by the "neck squeezing" method above, the circumferential seal between the outer edge of the barrier flap 300 and the inner circumferential sealing region 108 disengages. This allows the container's fluids 500 to gravitationally flow out when the container is inverted, such as shown in FIG. 7.

Figure 7:
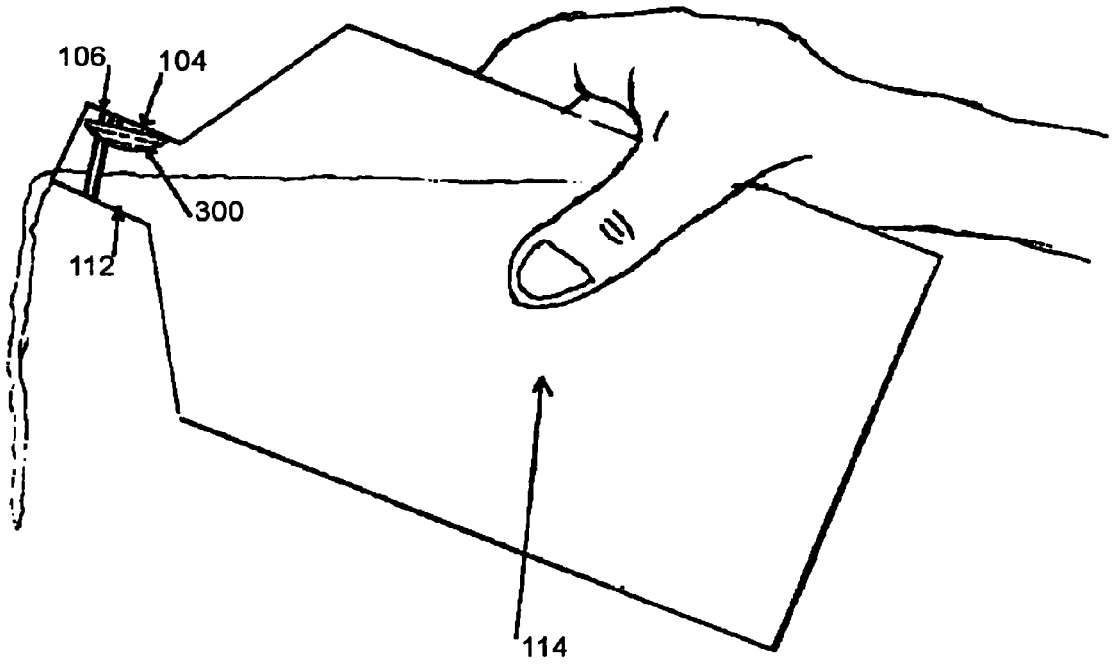
FIG. 7. is a front view of a tilted container showing the barrier flap in the "open" position, thereby allowing the liquid to flow out when the container is tilted.

FIG. 7 shows a hand inverting the container 100 after the barrier flap 300 has hinged into its "open" position, thereby allowing fluid to flow out. This second "neck squeezing" method allows greater flow control of the fluid because after the barrier flap has moved to its "open" position, the container can be inverted to any desired degree for a manually adjusted flow rate. Once inverted, the fluid begins to flow out due to gravitational forces.

Figure 8:
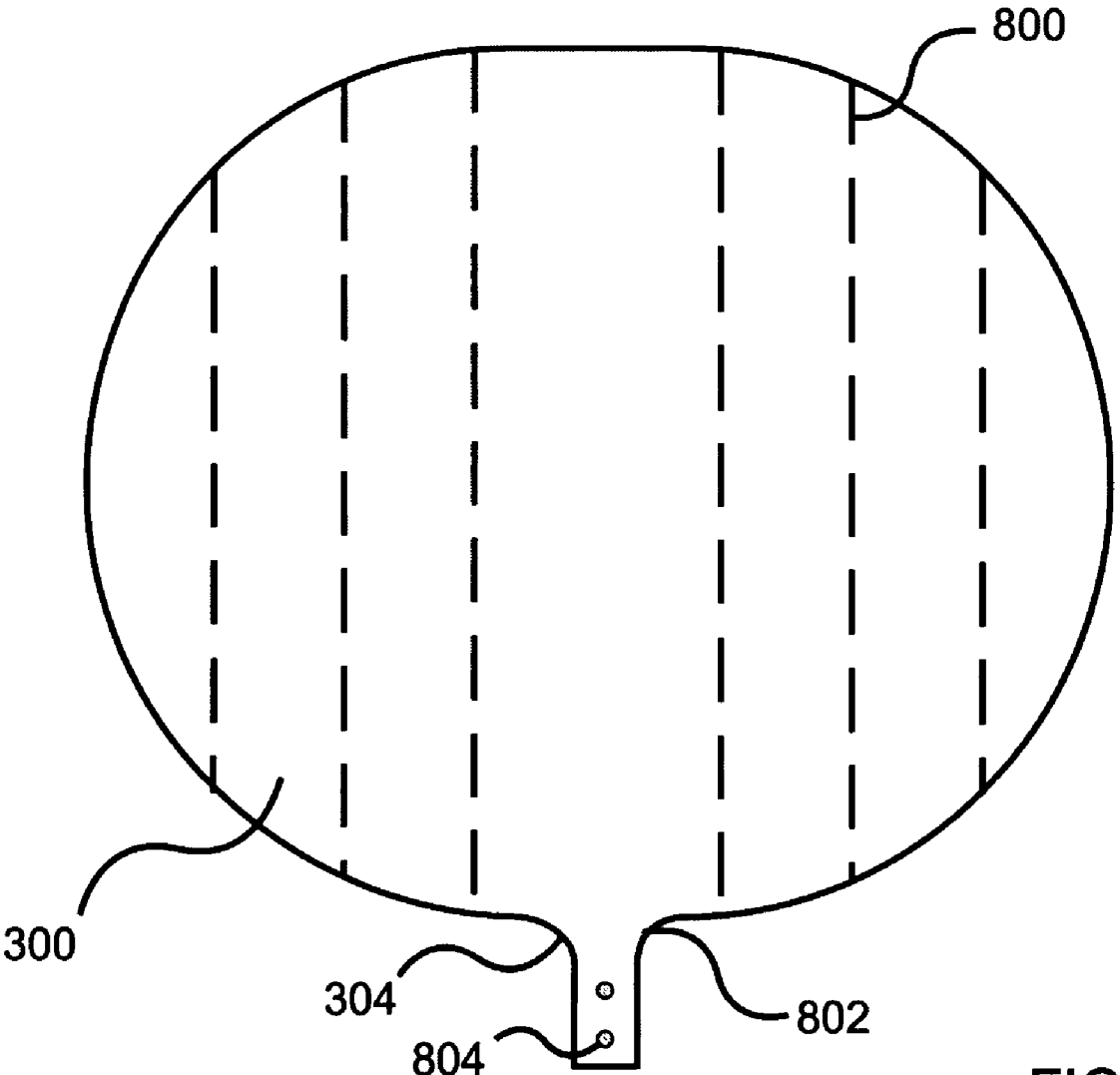
FIG. 8. is a side view of the barrier flap showing it in a flat and un-arced configuration.

FIG. 8 shows a close-up side view of the barrier flap 300 in its un-arced and "open" position. FIG. 8 shows a barrier flap 300 with a hinging region 304. This is the natural unstressed state of the hinging region maintaining the barrier flap 300 in the "open" position, such as FIG. 23. The barrier flap flange 802 is where the container attachment 804 is located allowing the barrier flap 300 to be attached to the inner neck 104 of the container 100. The optional grooves 800 on the barrier flap 300 allow it to arc inwardly so the barrier flap can rest along the inner curvature of neck wall when the barrier flap 300 is in the "open" position FIG. 23. Barrier flap arcing can be achieved with assistance of optional grooves 800 or with material(s) allowing the same arcing curvature.

FIG. 8.5 is a close-up side view of a similar barrier flap 300 in its un-arced and "open" position. Instead of a one-piece barrier flap such as in FIG. 8, this figure shows optional multi-piece components, including a "spring-like" attachment 8500 that attaches to the barrier flap 300 at attachment point 8502 and also attaches to the container 100 at an attachment point 804.

Figure 9:
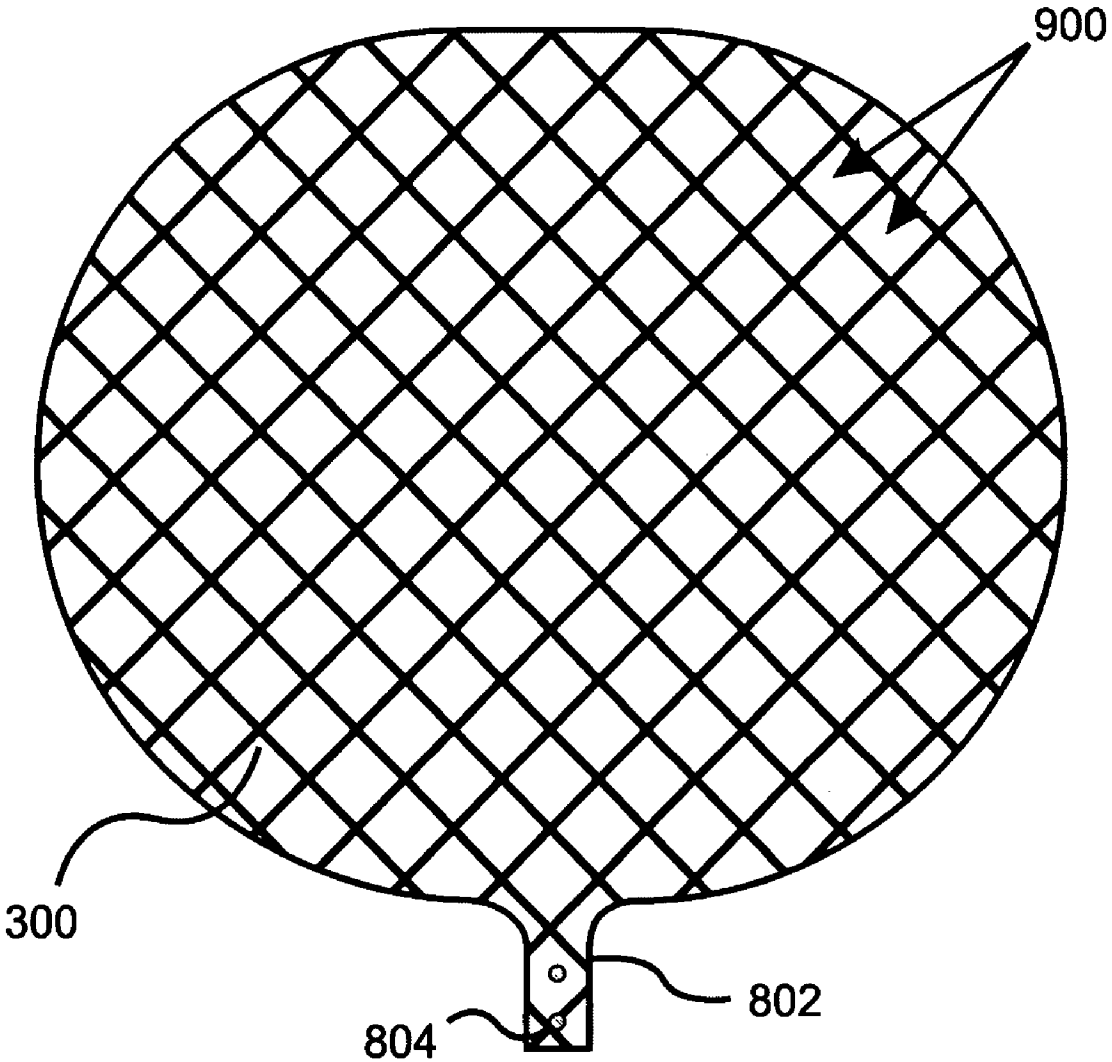
FIG. 9. is a side view of the barrier flap showing it in a flat and un-arced configuration, also showing a protective film covering the barrier flap.

FIG. 9 shows the other side view of the barrier flap 300 in its un-arced and "open" position. From this view, an optional protective covering 900 is shown. This protective covering 900 attaches to the barrier flap 300 and maintains the structural integrity of the barrier flap 300 together with its components. It ensures that the barrier flap 300 will remain as one piece in case of structural failure of any part of the container or of the barrier flap 300 itself. This is vital, since no piece of the barrier flap 300 or container interconnections should ever become dismembered before, during, or after application of either squeezing method of the container.

FIG. 9.5 is similar to FIG. 9 except instead of a barrier flap flange, the "spring like" attachment 8500 is attached to the barrier flap 300. The "spring like" attachment attaches together to the barrier flap 300, at attachment point 8502, and the to the container 100 at attachment point 804.

Figure 10:
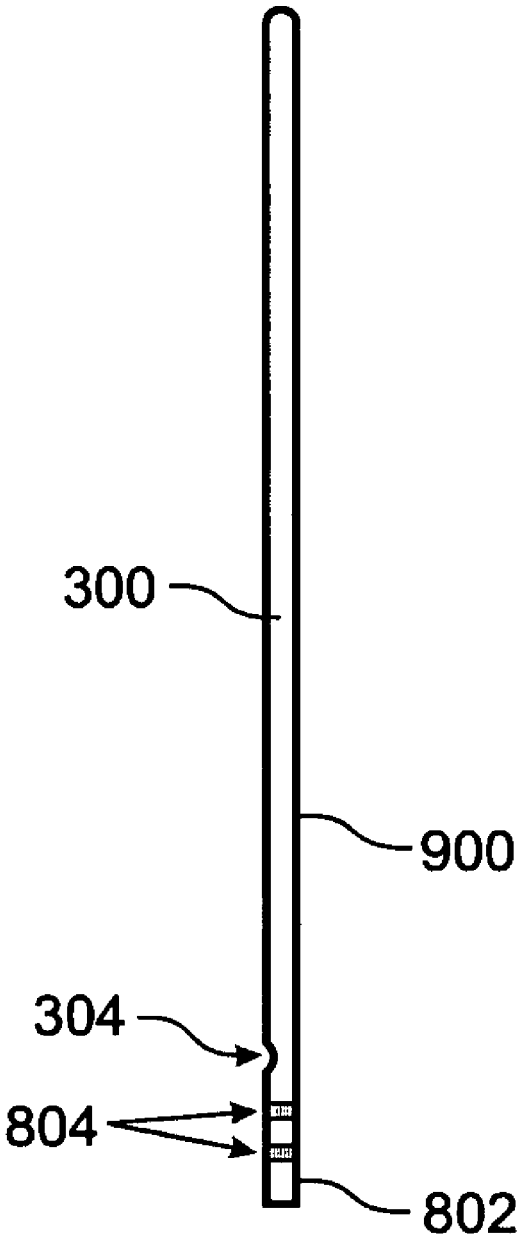
FIG. 10. is a front view of the barrier flap showing it in an un-arced and "open" position.

FIG. 10 shows the front view of the barrier flap 300 in its un-arced and "open" position. From this view, the protective shield 900 from FIG. 9 and FIG. 9.5 is noticeable as a thin layer on one side of the barrier flap. FIG. 10 also shows the hinging region 304 and container attachment points 804 on the barrier flap flange 802.

FIG. 10.5 also shows the front view of the barrier flap 300 in its un-arced and "open" position. It is very similar to FIG. 10 except that it contains a "spring-like" attachment 8500 with a container attachment 804 and a barrier flap attachment 8502.

Figure 11:
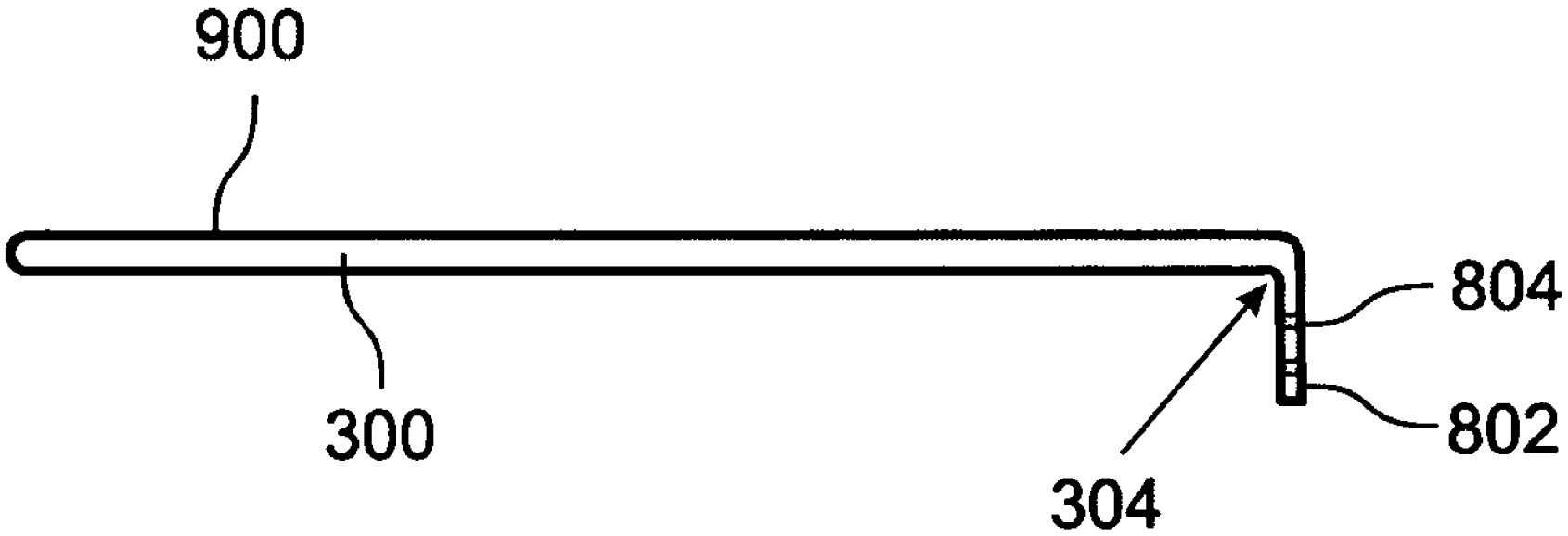
FIG. 11. is a front view of the barrier flap showing it in an un-arced and "closed" position.
Figure 12:
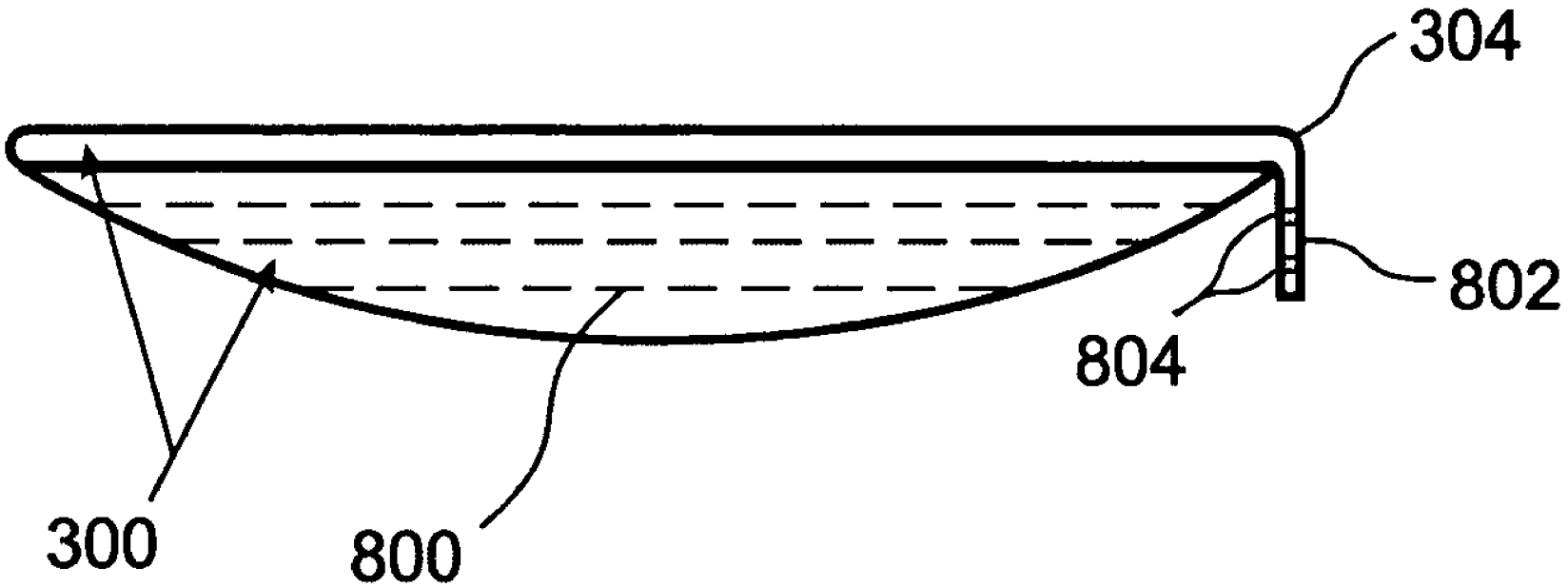
FIG. 12. is a front view of the barrier flap showing it in a "closed" position as it would be inside a container.

FIG. 11 shows the front view of the barrier flap 300 in its un-arced and "closed" position. It is similar to FIG. 10 except that the barrier flap 300 is no longer in its natural unstressed "open" position but has been "closed" by rotating about the hinging region 304. In the container's "closed" position, the barrier flap 300 can remain in this un-arced position, or in a slightly arced position as shown in FIG. 12. The barrier flap's inherent disposition is to hinge "open" from this "closed" position about its hinging region 304. The barrier flap 300 in FIG. 11 remains un-arced but becomes slightly arced in FIG. 12.

FIG. 11.5 also shows the front view of the barrier flap 300 in its un-arced and "closed" position. It is similar to FIG. 10.5 except that the barrier flap 300 is no longer in its natural unstressed position but has been hinged "closed" using the hinge 304. The barrier flap 300 is shown un-arced in FIG. 11.5 but can also be slightly arced as shown in FIG. 12.5.

FIG. 12 shows the front view of the barrier flap 300 in its slightly arced and hinged "closed" position. It is similar to FIG. 11 in that the barrier flap 300 is hinged "closed" about the hinging region 304, but now the barrier flap 300 is slightly arced. The barrier flap 300 has a barrier flap flange 802 that attaches to a container 100. This is the configuration of the barrier flap 300 when it is attached inside of the container in its "closed" position. Or as mentioned previously, in the "closed" position, the barrier flap 300 can be in a slightly arced or in an un-arched position, as shown in FIG. 11. A slight arc of the barrier flap 300 is preferred, as it helps assist the flap 300 to arc convexly when it hinges open and rests against the inner neck wall when finally in the "open" position.

FIG. 12.5 also shows the front view of the barrier flap 300 in its slightly arced and "closed" position. It is similar to FIG. 11.5 in that the barrier flap 300 is hinged "closed" at its hinge 304, but now the barrier flap 300 is arced. Unlike FIG. 12 where there is a barrier flap flange 802 that attaches to a container 100, FIG. 12.5 has a "spring-like" hinge attachment 304 that attaches to the barrier flap 300 and to a container 100.

Figure 13:
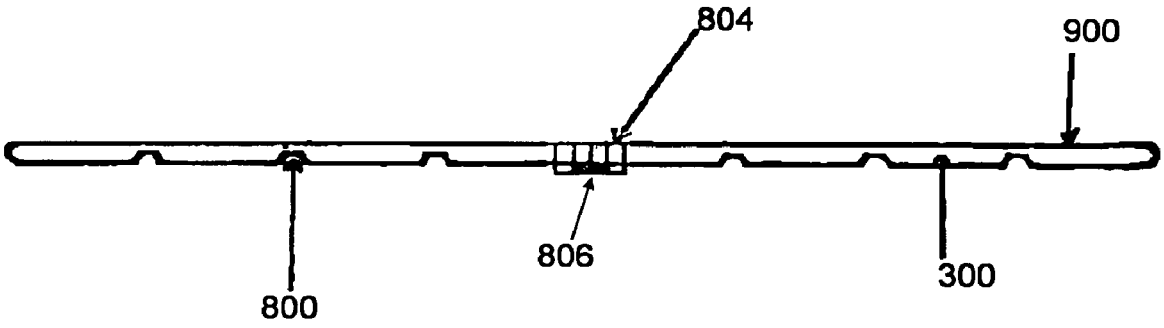
FIG. 13. is a top view of the barrier flap showing it in an un-arced and "open" position.

FIG. 13 shows the top view of the barrier flap 300 in its un-arced and "open" position. From this view, the optional grooves 800 in the barrier flap 300 are noticeable. The grooves can be situated on either side or both of the barrier flap 300 which assist in arcing of the barrier flap 300. Also noticeable is the protective covering 900 on one side of the barrier flap 300.

Figure 14:
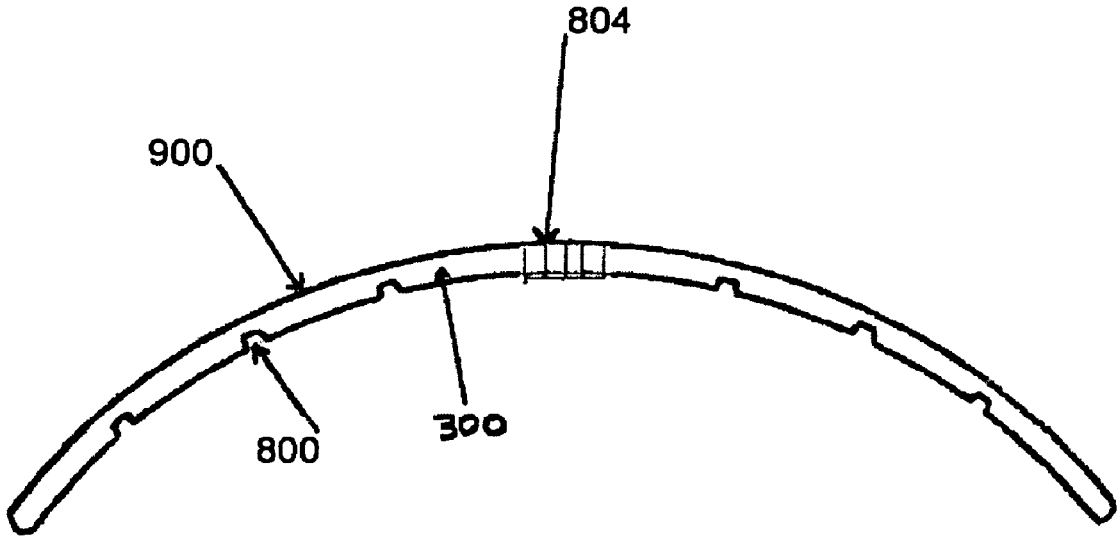
FIG. 14. is a top view of the barrier flap showing it in a slightly arced and "open" position.

FIG. 14 shows the top view of the barrier flap 300 in its significantly arced and "open" position. It is a similar view as shown in FIG. 13, except the barrier flap 300 is now arced, which can be achieved with optional grooves 800, or with material(s) that allow and facilitate the barrier flap 300 to form a similar arced position. This is the position the barrier flap 300 will remain in once inside the container's neck when it hinges to its "open" position.

Figure 15:
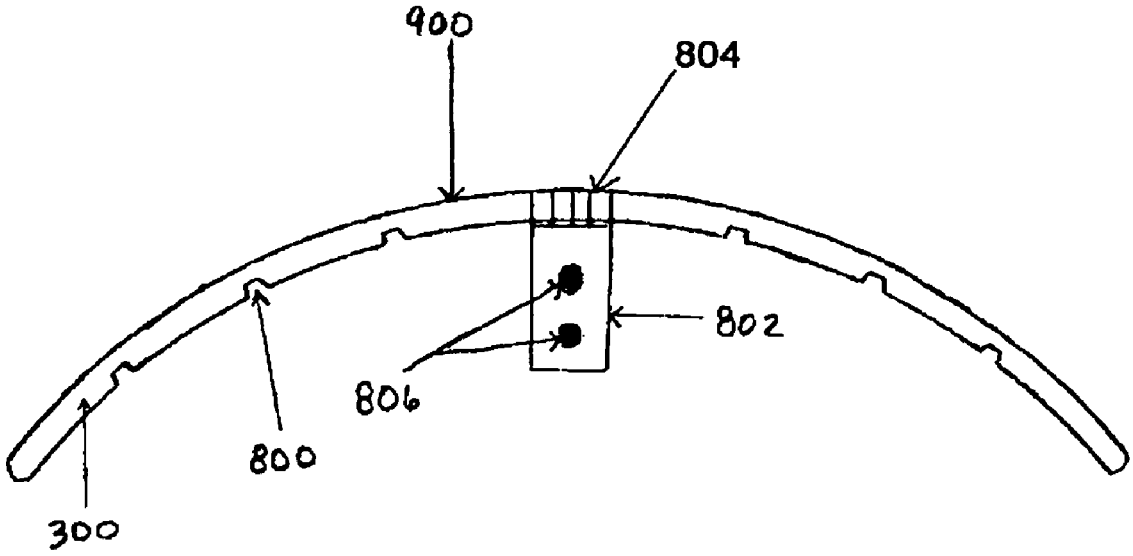
FIG. 15. is a side view of the barrier flap showing it in a slightly arced and "open" position, the barrier flap also having a "spring-like" hinge.

FIG. 15 shows the side view of the barrier flap 300 in its slightly arced and "closed" position. Again in the "closed" position, the barrier flap 300 can be slightly arced or un-arced, although a slight arc is preferred to assist in arcing of the flap 300 when hinging open. This is the position the barrier flap 300 will be positioned in once inside of the container in the "closed" position. This figure shows the use of the "spring-like" attachment 304, rather than the barrier flap flange 802. Either option is interchangeable when attaching the barrier flap 300 to the container 100. Of course, any functional equivalent, providing a hinging or pivoting action, would be effective also.

Figure 16:
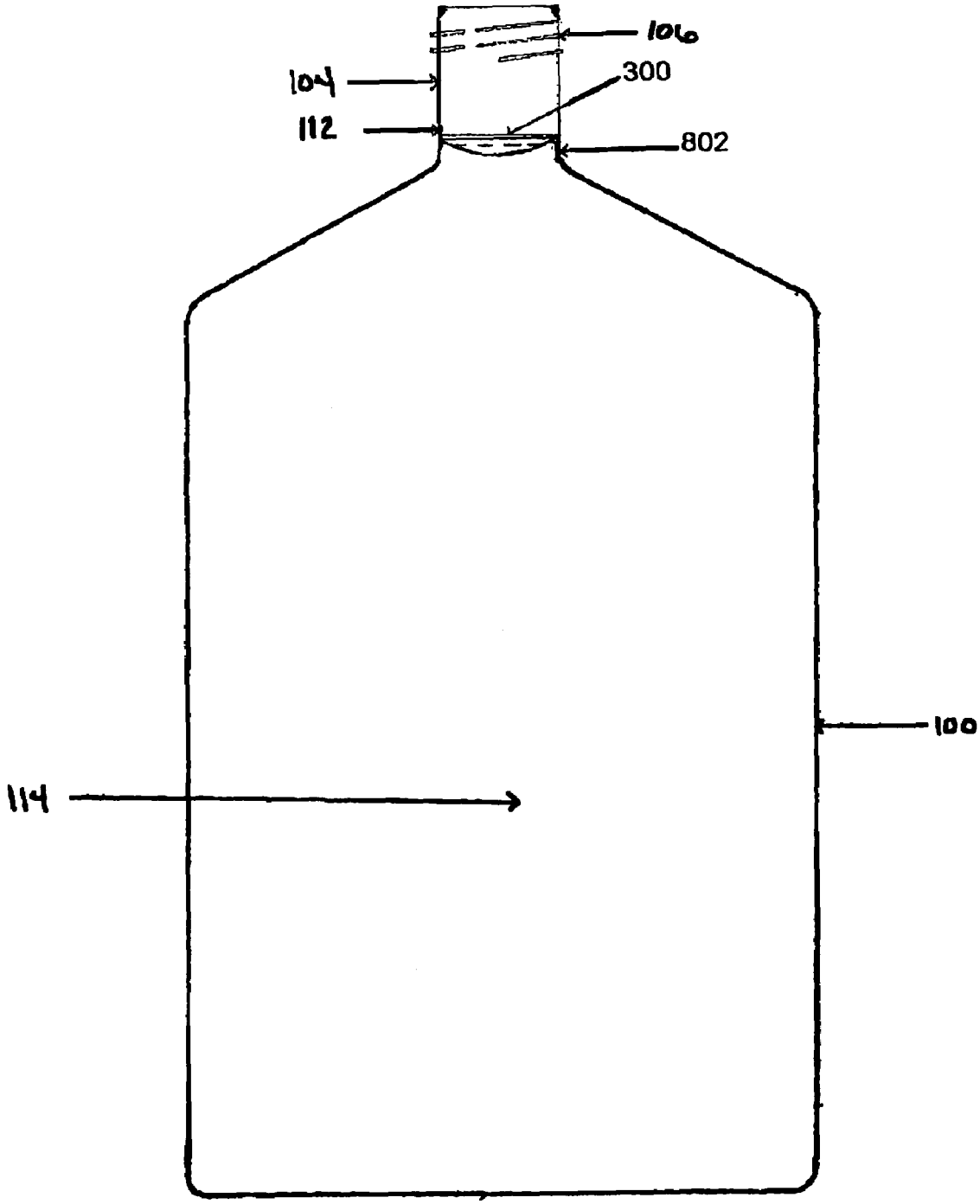
FIG. 16. is a front view of a container showing the barrier flap in its slightly arced and "closed" position.

FIG. 16 shows the front view of a container 100 with the barrier flap 300 attached to the container in the "closed" position. Attached together, the components form a valve that controls the flow of fluid from the container 100. The barrier flap 300 is in the slightly arced and hinged "closed" position. In this position, the barrier flap is engaged in a circumferential seal along the circumferential sealing region 108. Also in this position, no fluid or gas exchange can occur between the inside and outside of the container 100.

FIG. 17 shows the front view of a container 100 with the barrier flap 300 attached to the container 100 in the "open" position. The barrier flap 300 is in the substantially arced and hinged "open" position. In this position, the barrier flap 300 has become disengaged from the circumferential seal along the circumferential sealing region 108. Also in this position, fluid and gas can be exchanged between the inside and outside of the container 100.

Figure 18:
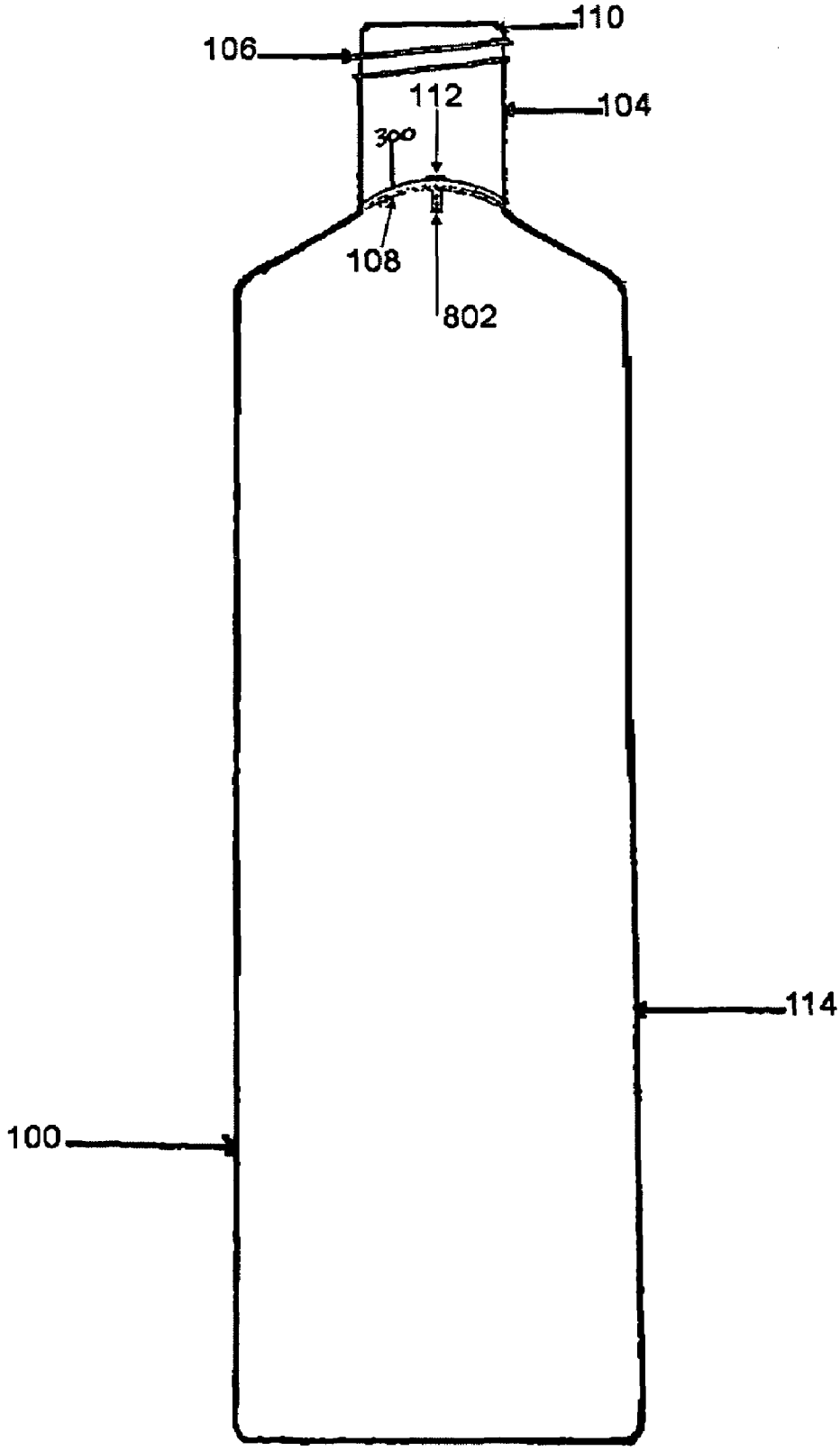
FIG. 18. is a side view of a container showing the barrier flap in its arced and "closed" position.

FIG. 18 shows the side view of a container 100 with the barrier flap 300 attached to the container 100 in the "closed" position. The barrier flap 300 is in the slightly arced and hinged "closed" position. In this position, the barrier flap 300 is engaged in a circumferential seal along the circumferential sealing region 108. In this position, no fluid or gas exchange can occur between the inside and outside of the container.

Figure 19:
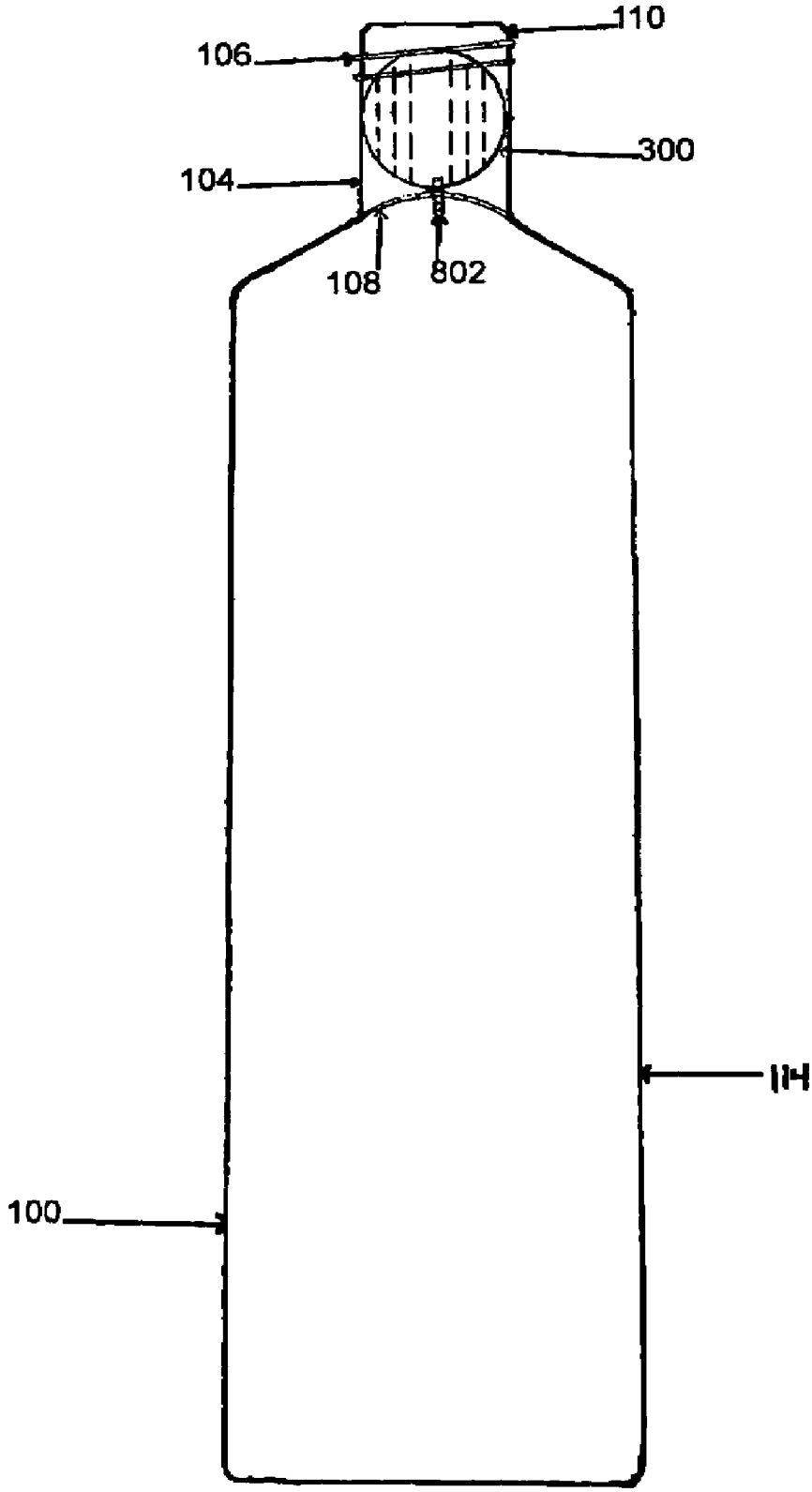
FIG. 19. is a side view of a container showing the barrier flap in the substantially arced and "open" position.

FIG. 19 shows the side view of a container 100 with the barrier flap 300 attached to the container by the container attachment 804 and the barrier flap 300 is in the "open" position. The barrier flap 300 is in the substantially arced and "open" position. In this position, the barrier flap 300 is now disengaged from the circumferential seal along the circumferential sealing region 108, thereby allowing fluid and gas exchange between the inside and outside of the container.

Figure 20:
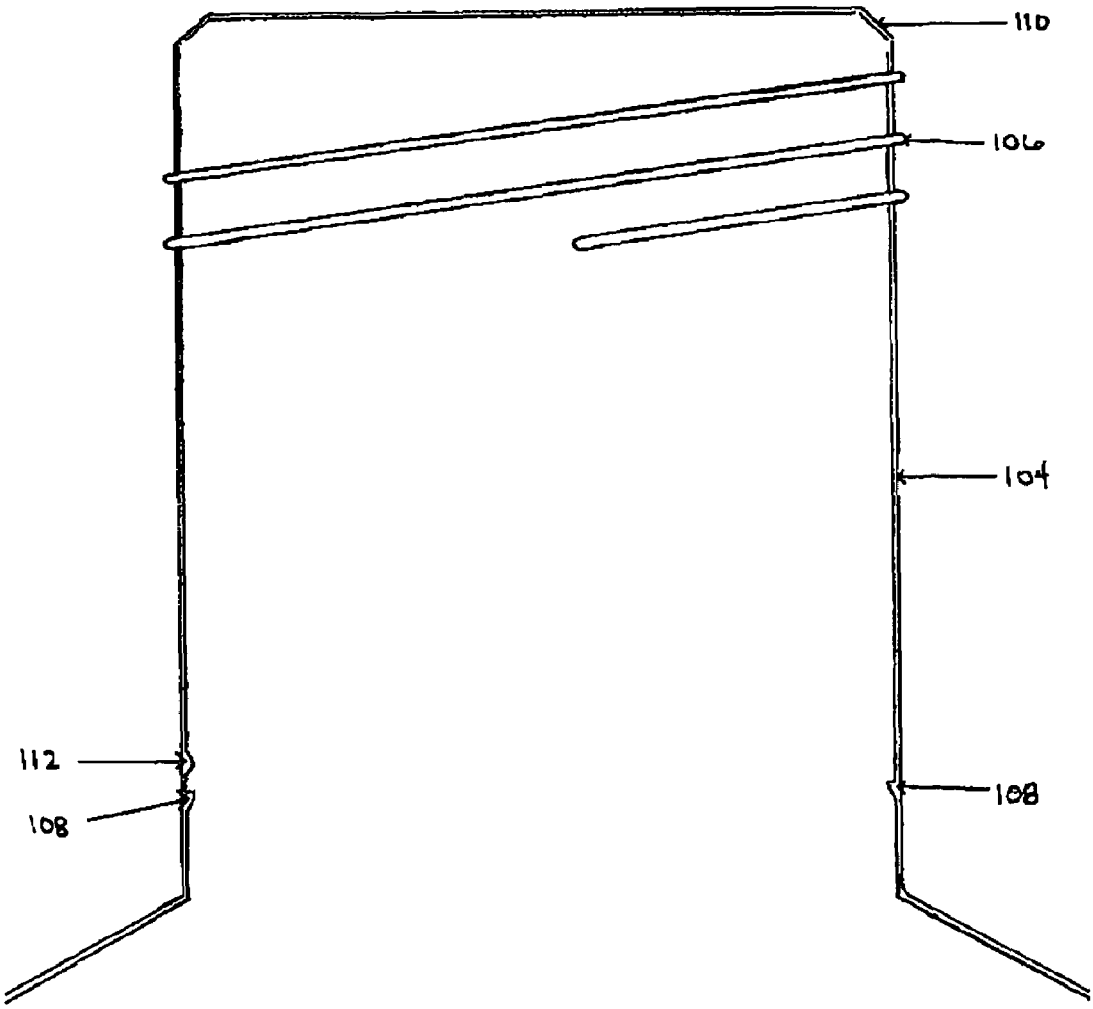
FIG. 20. is a close up cross-sectional front view showing the circumferential sealing region, resistant stop, and indented opening in the container's neck.

FIG. 20 shows a close up front view of the container 100. From this view, the indented opening 110 is seen. This indented opening 110 prevents the barrier flap 300 from exiting from the neck of the container in case the barrier flap 300 accidentally becomes detached from the container 100. Also noticeable from this view are the optional threads 106 which provide assistance when using a container cap with the container 100. The resistance stop 112 is also shown. This resistance stop 112 ensure that the barrier flap 300 stays in place when in the "closed" position, in the absence of any substantial applied squeezing force to the neck or body of the container 100. Also, a cross-sectional view of the circumferential sealing region 108 is shown. This circumferential sealing region runs along the inner perimeter of the neck 104, as seen in FIG. 21.

Figure 21:
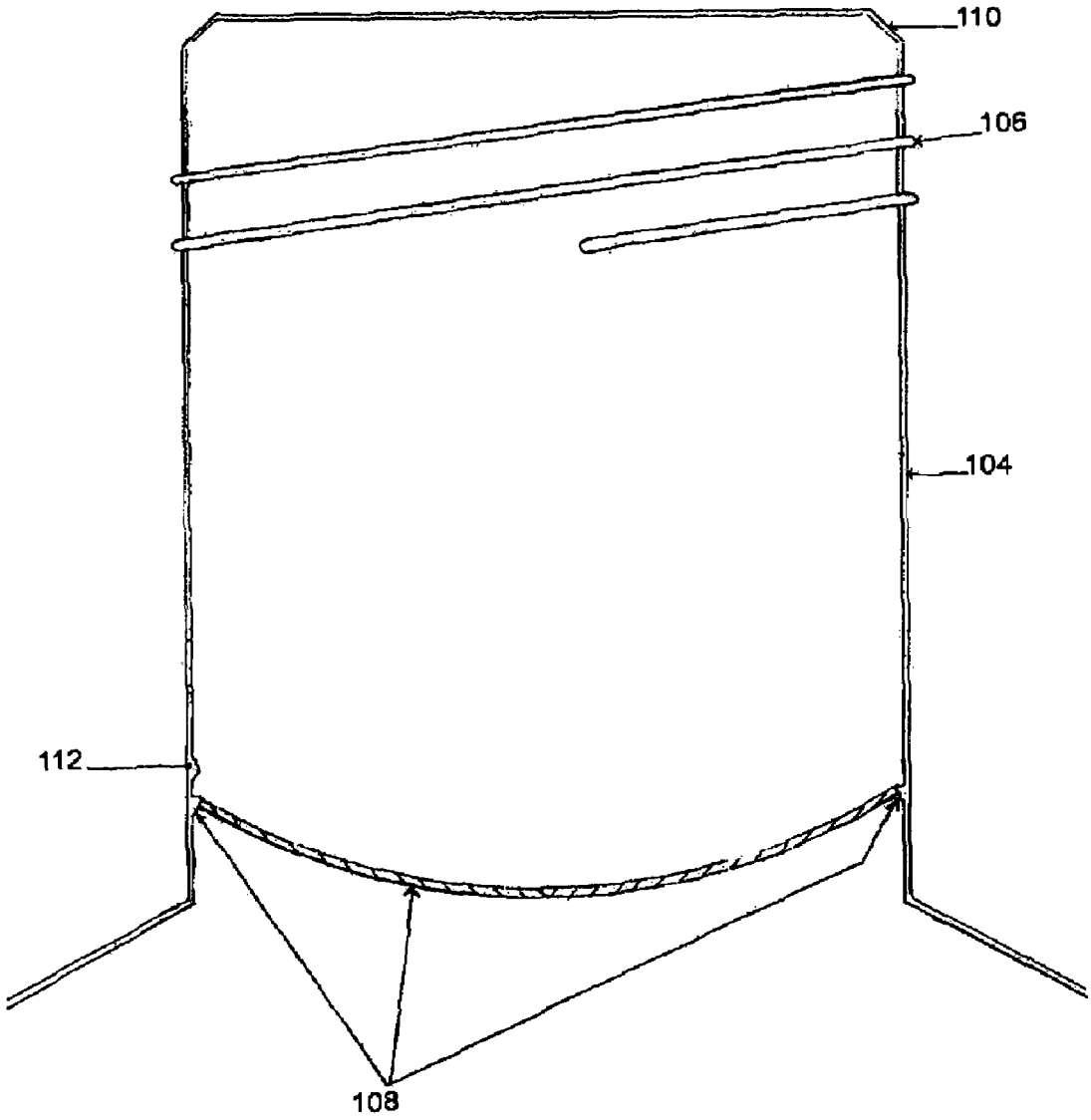
FIG. 21. is a close up front view showing the circumferential sealing region extending all around the circumference of the neck.

FIG. 21 is a close up front view of the container 100. This view is similar to FIG. 20, except it shows a full frontal view of the circumferential sealing region 108 and how it extends around the inner circumference of the container's neck 104. When in engaged relationship with the barrier flap 300 as in FIG. 22, together the barrier flap 300 and the circumferential sealing region 108 form a circumferential seal.

Figure 22:
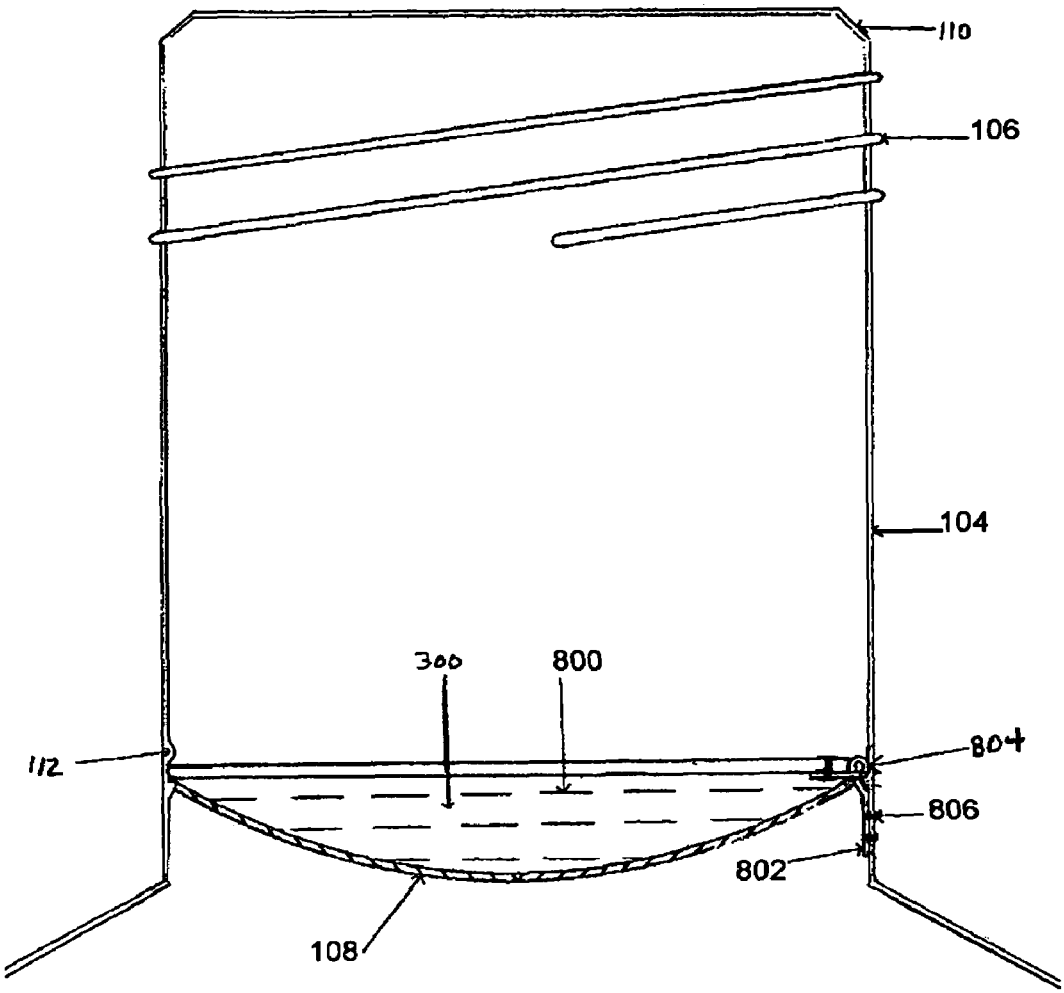
FIG. 22. is a close up front view showing the circumferential sealing region extending all around the circumference of the containers neck, also showing the barrier flap in its slightly arced and "closed" position within the container.

FIG. 22 is a close up front view of the container. This view is similar to FIG. 21 except it includes the barrier flap 300 and "spring-like" hinged attachment 804 attached to the container 100. The barrier flap 300 is slightly arced and in the "closed" position. Together with the circumferential sealing region 108, they form a circumferential seal preventing the exchange of fluid or gas between the inside and outside of the container 100. While the barrier flap 300 is in the "closed" position, the resistance stop 112 is applying pressure against the barrier flap 300, thereby preventing it from moving into the "open" position. The barrier flap 300 must overcome the pressure applied by the resistance stop to pivot into the barrier flap's "open" position. Once the barrier flap 300 overcomes the pressure applied by the resistance stop 112 and begins moving away from the circumferential sealing region 108, such as shown in FIG. 23, the circumferential seal becomes disengaged, allowing fluid and gas exchange between the inside and outside of the container 100.

FIG. 23 is a close up front view of the container. This view shows how the barrier flap 300 has moved from the "closed" position FIG. 22, to the "open" position FIG. 23. As it can be seen, the barrier flap 300 has overcome the force of the resistance stop 112 and has continued to move towards its "open" position against the inner neck wall 104 of the container 100. Since the barrier flap 300 has moved away from circumferential sealing region 108, the circumferential seal has been disengaged, thereby allowing the exchange of fluid and gas between the inside and outside of the container 100.

Figure 24:
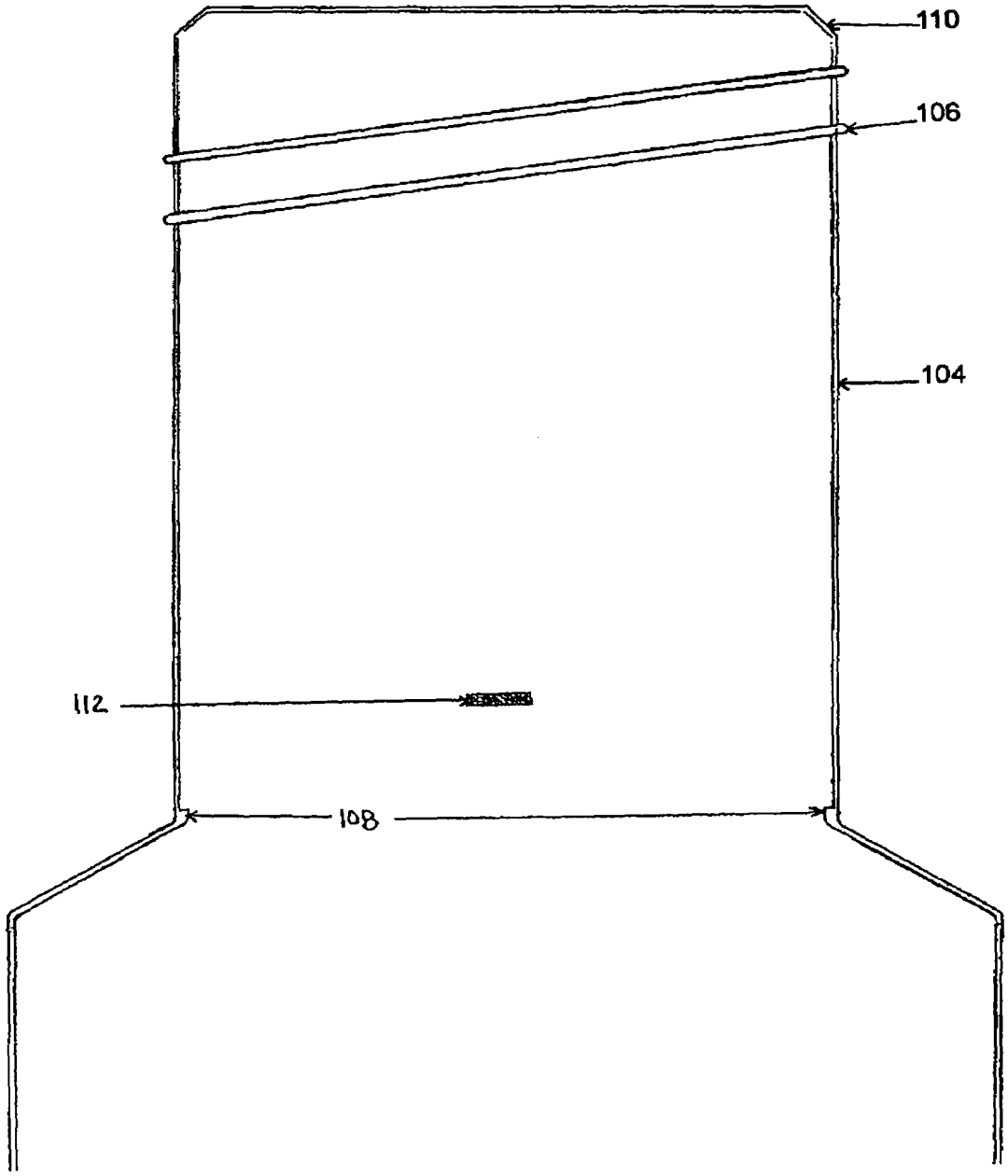
FIG. 24. is a cross-sectional side view showing the circumferential sealing region, also showing a resistance stop above the circumferential sealing region.
Figure 25:
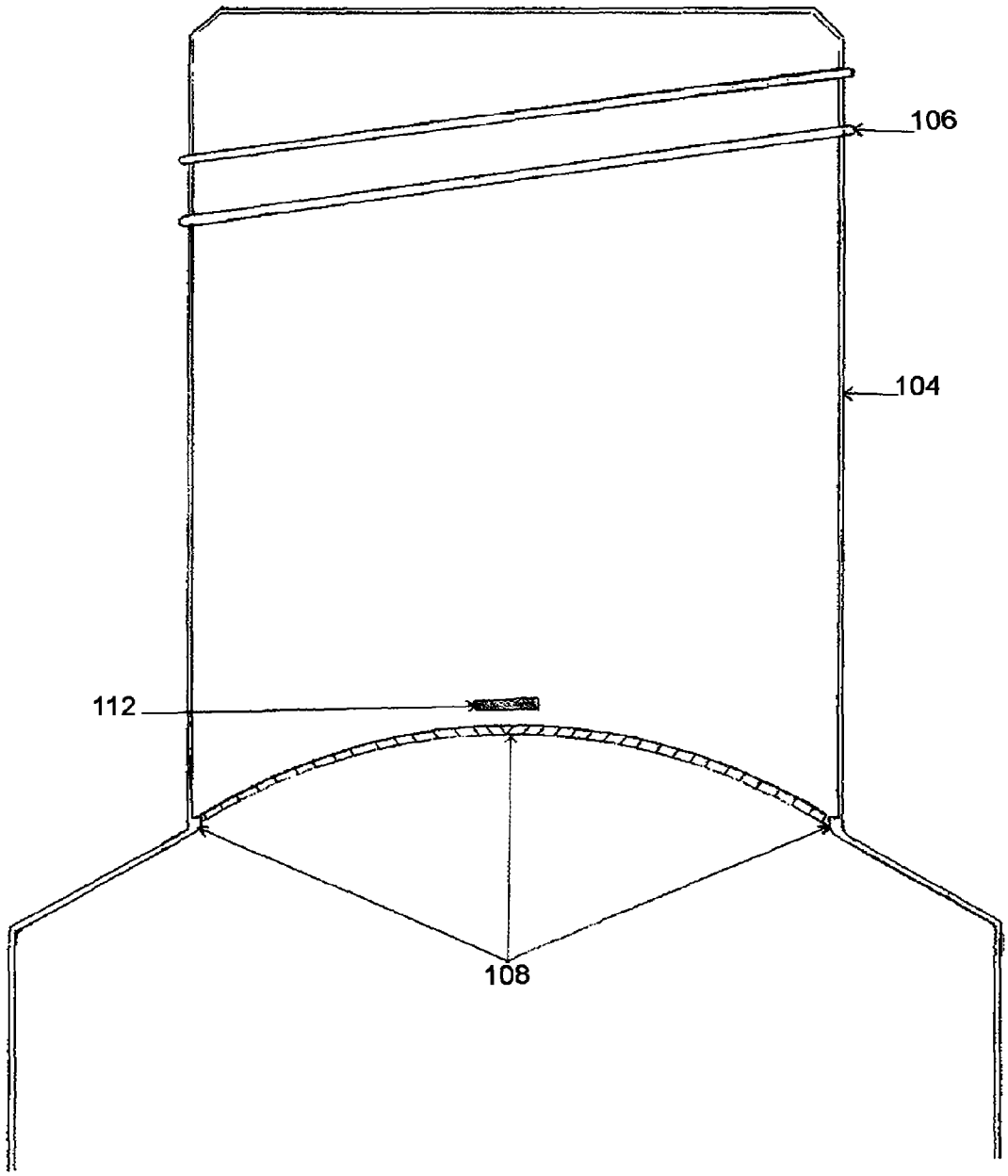
FIG. 25. is a close-up side view of the container without the barrier flap in place, showing the circumferential sealing region on the inner wall of the neck, also showing the resistance stop on the inner wall of the neck.

FIG. 24 is a close up side view of the container 100. FIG. 24 is similar to FIG. 20, except FIG. 20 is a front view of the container 100, and FIG. 24 is the side view of the container 100. Both views show the cross-sectional view of the circumferential sealing region 108. FIG. 25 shows a side view of the resistance stop 112, and its placement above the circumferential sealing region 108.

FIG. 25 is a close up side view of the container 100. FIG. 25 is similar to FIG. 21, except FIG. 21 is the front view of the container 100, and FIG. 25 is the side view of the container 100. Both views show a full view of the circumferential sealing region 108.

Figure 26:
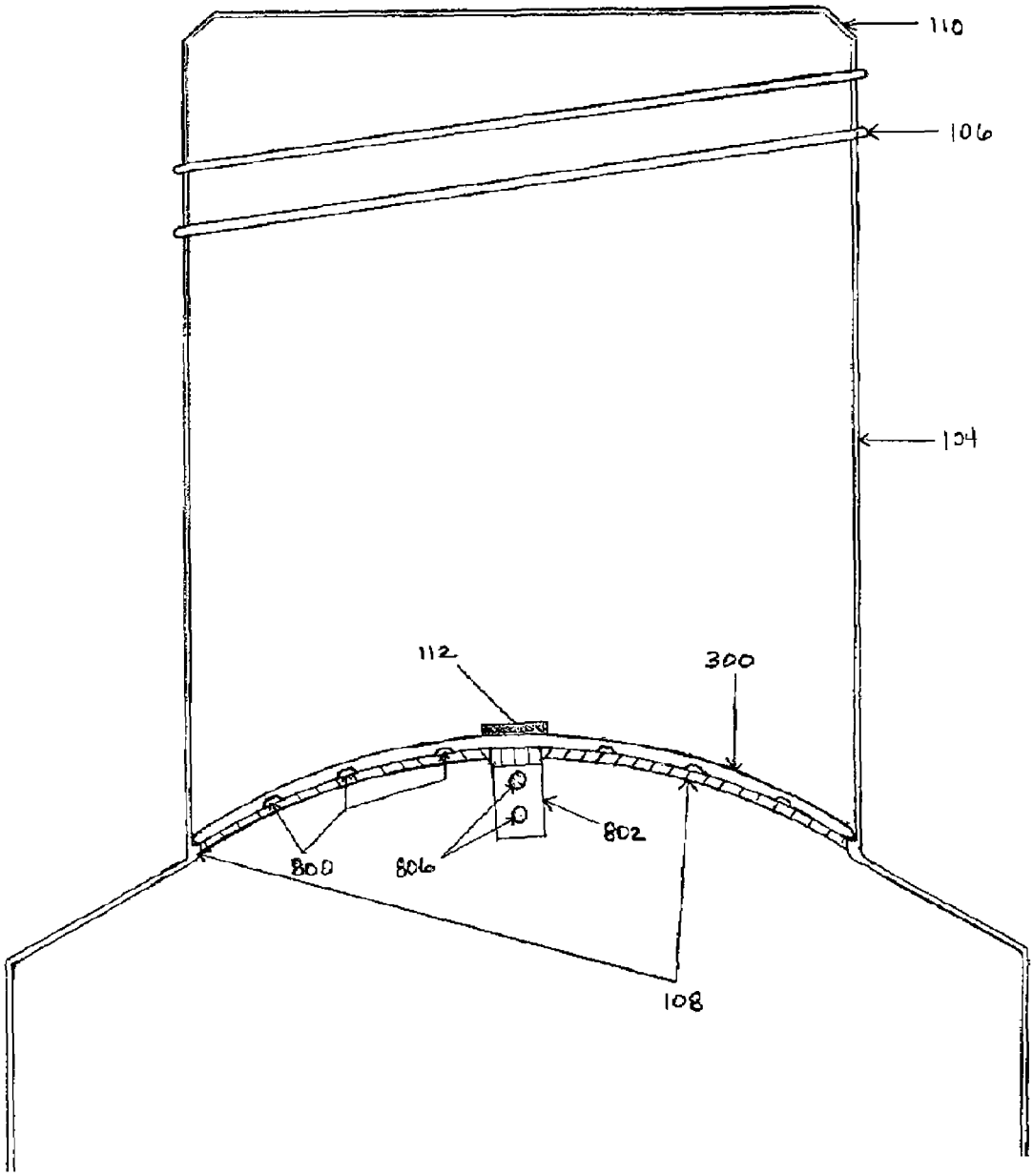
FIG. 26. is a close-up side view of the container showing the barrier flap in place, and in its slightly arced and "closed" position.

FIG. 26 is a close up side view of the container 100. FIG. 26 is similar to FIG. 22 except FIG. 22 is a front view of the container 100, and FIG. 26 is a side view of the container 100. Both views show the barrier flap 300 attached to the container 100 in the slightly arced and hinged "closed" position. In FIG. 26, the barrier flap 300 together with the circumferential sealing region 108, form a circumferential protective seal around the inner circumference of the container's neck 104. FIG. 26 shows the relative positioning of the barrier flap 300 and the resistance stop 112. While the barrier flap 300 is in the "closed" position, the resistance stop 112 applies obstructive force against the barrier flap 300 to ensure that it remains in the "closed" position.

Figure 27:
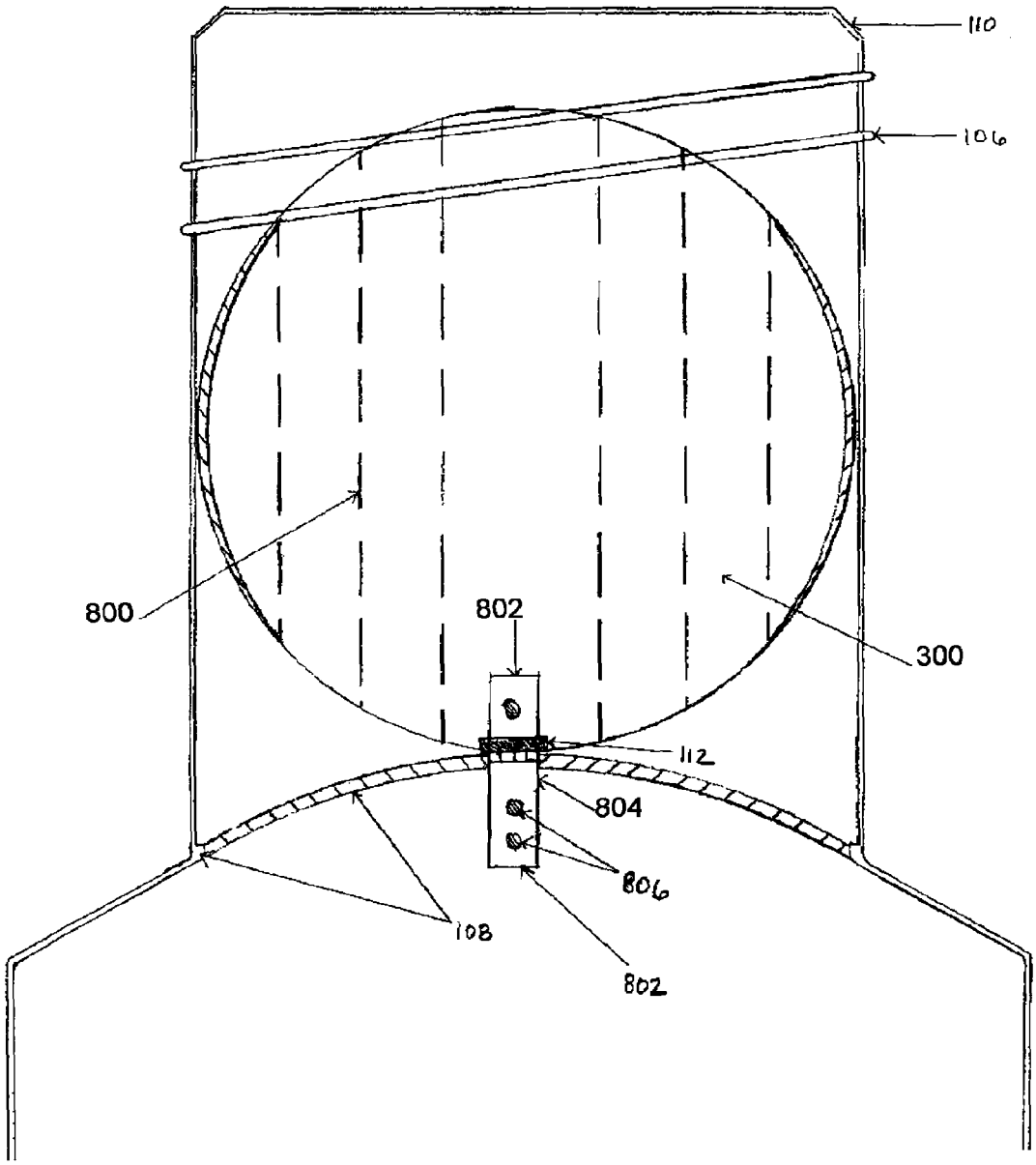
FIG. 27. is a close-up side view of the container showing the barrier flap in place, and in its substantially arced and "open" position.

FIG. 27 is a close up side view of the container 100. In FIG. 27 the barrier flap 300 has moved beyond the resistance stop 112, and has continued on towards the "open" position, with the barrier flap 300 resting along the inner neck 104 wall of the container 100. This view is similar to FIG. 23, except that FIG. 23 is a front view, and FIG. 27 is a side view of the barrier flap 300 in the "open" position. In this "open" position, fluid and gas are able to be exchanged from the inside and outside of the container.

FIG. 28 is a close up top view of the container's mouth 116. From this view, a guard 2800 can be seen inside the container's mouth 116. The guard's purpose, similar to the indented opening 110, is to prevent the barrier flap 300 from exiting the mouth of the container in case the barrier flap 300 accidentally becomes detached from the container 100. Also, from the view in FIG. 28, the barrier flap 300 is shown in its arced and "closed" position, not allowing any exchange of fluid or gas between the inside and outside of the container 100.

Figure 30:
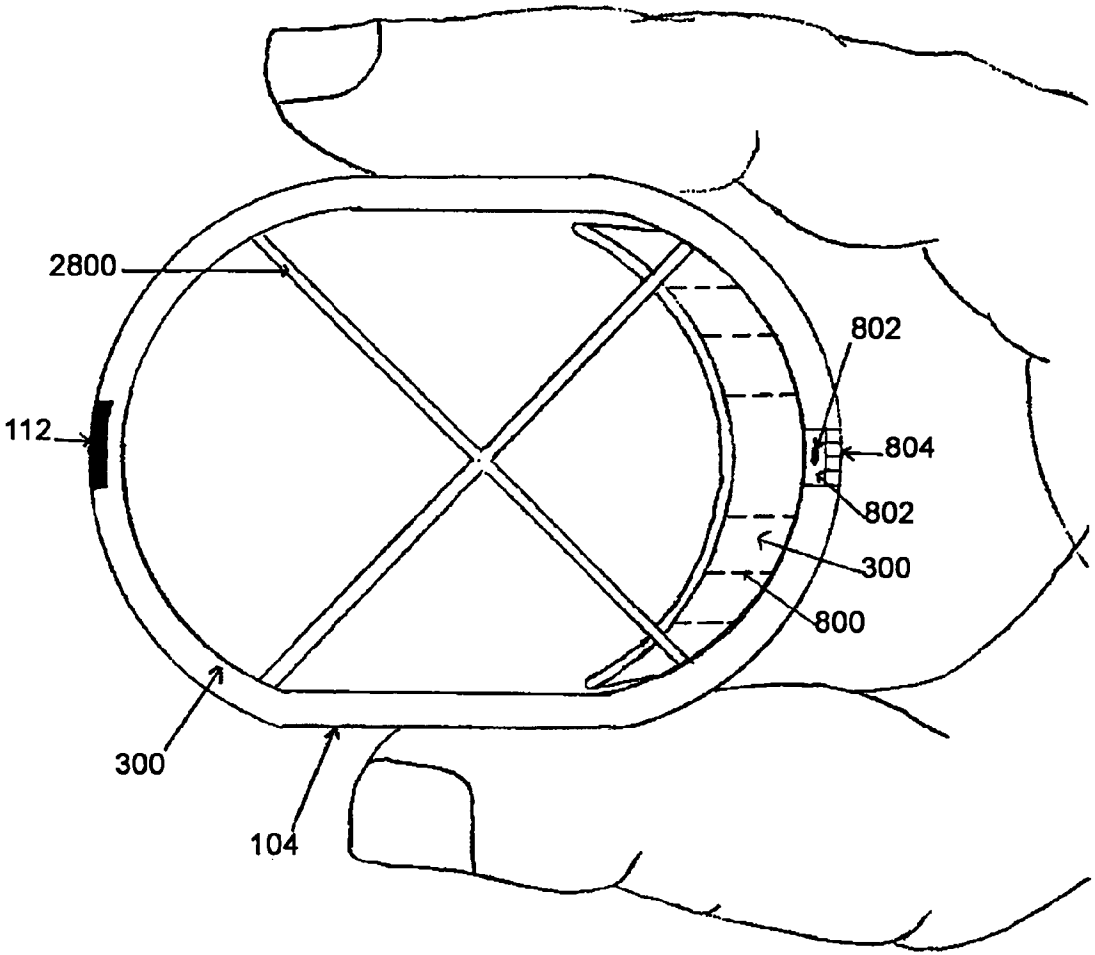
FIG. 30. is a top view of the mouth after the neck has been squeezed and the barrier flap has opened.

FIG. 29 is a close up top view of the container's mouth 116 being squeezed by a hand 304 at the container's neck 104 with the barrier flap 300 in the "closed" position. As the neck's wall is being squeezed, the shape of the neck 104 is becoming elongated, causing the resistance stop 112 to move away from the barrier flap 300. As the resistance stop 112 moves away from the barrier flap 300, the obstructive force applied by the resistance stop 112 is removed from the barrier flap 300, thereby allowing the barrier flap 300 to avoid the resistance to movement provided by the resistance stop 112. Once the resistance stop 112 releases the barrier flap 300, the barrier flap 300 is able to freely pivot from its "closed" stressed position, towards its "open" unstressed position about the hinge 804, until the barrier flap 300 comes to rest at the neck wall 104, such as shown in FIG. 30. Also, while the neck 104 is squeezed with the hand 302, pressure is being applied to the barrier flap 300 by the neck wall 104. The grooves 800 enable the barrier flap 300 to significantly arc, thereby allowing the barrier flap 300 to conform to the new temporary elongated oval neck shape. If the resistance stop 112 does not fully move away from the barrier flap 300 during squeezing of the neck 104, the significantly arced barrier flap shape applies further pressure on the resistance stop 112 to as to overcome the obstructive force from the resistance stop 112, thereby enabling the barrier flap 300 to move to the "open" position.

FIG. 30 is a close up top view of the container's mouth 116 being squeezed by a hand 304 at the container's neck 104 with the barrier flap 300 moving towards the "open" position. From this view, the temporary oval neck shape can be seen which has resulted from the squeezing pressure on the neck's wall.

Figure 31:
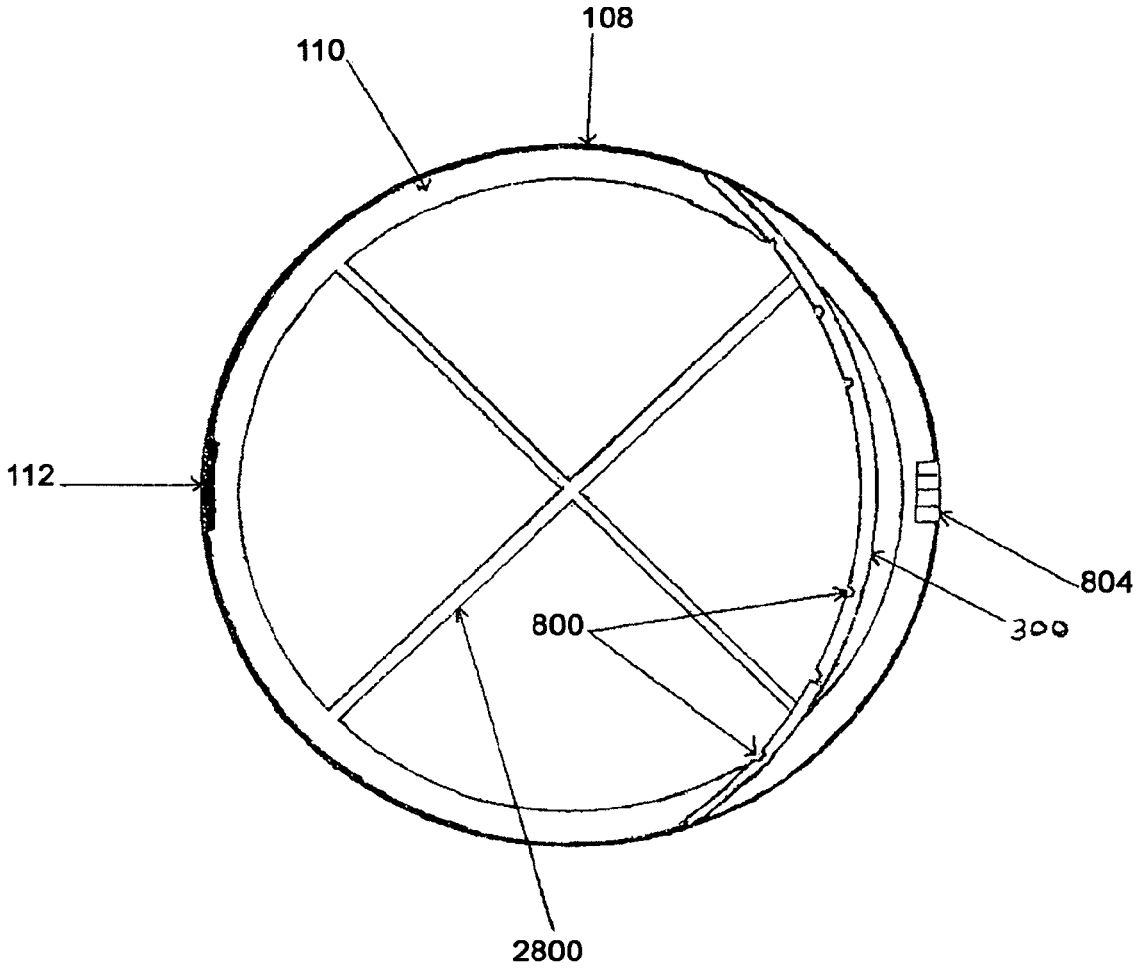
FIG. 31. is a top view of the mouth of the container, showing the barrier flap substantially arced and in the "open" position, also showing the safety guard and the resistant stop.

FIG. 31 is a close up top view of the container's mouth 116 after the neck 104 has been squeezed and after the barrier flap 300 has moved into the "open" position. After the hand 302 has released the applied pressure on the container's neck 104, the neck shape regains its original circular shape. The resistance stop 112 returns back to its original position, but the barrier flap 300 remains in its new significantly arced, "open" position. In this position of the barrier flap 300, fluid and gas can be exchanged between the inside and outside of the container.

How the Pressure Pop™ Bottle Works

Method 1—"Body Squeeze": After the containers cap or seal is removed, the container 100 is placed in an inverted position over the pouring target, such as an engine crank-case oil opening, and is then squeezed, allowing the release of the fluid, such as oil. Since the barrier flap 300 within the containers neck 104 opens only when the container is squeezed, the user has control over the timing of the release of the fluid into the pouring target. With this method, the squeezing action, flap opening, and fluid flow out of the container occur simultaneously. After use, the user does not need to come in contact with any fluid from the container 100, but must merely dispose of the container 100, or reapply the containers cap for later reuse of the container 100.

Method 2—"Neck Squeeze": After the seal or cap is removed, the container 100 is placed in an upright position near the pouring target. The user can then squeeze the neck 104 of the bottle 100, thereby urging the flap 300 within the neck 104 of the container 100 to open. Then the container 100 can be positioned as needed so as to pour the fluid therefrom. A typical use for this method is when a user would like to slowly pour, or pour limited quantities of, the container's contents, such as oil, into an easy-to-reach and easy-to-pour location, such as a lawnmower engine, or a snow blower engine. This method also allows the fluid in the container 100 to pour out in accordance with a tilt of the container 100, rather than upon pressure-induced release of the barrier flap 300.

Other modifications and implementations will occur to those skilled in the art without departing from the spirit and the scope of the invention as claimed. Accordingly, the above description is not intended to limit the invention except as indicated in the following claims.

What is claimed is:

1. An apparatus for containing a fluid, and for controlling release and flow of the fluid contained therein, the apparatus comprising:

a container having a mouth, a neck, and a body, an inner surface of the neck including a continuous circumferential sealing region and a resistance stop; and a barrier flap attached to a narrow portion of the inner surface of the neck of the container by a hinged attachment located directly opposite to the resistance stop, the barrier flap being thereby hingedly pivotable between a closed position and an open position, the resistance stop being able to hold the barrier flap in the closed position, the barrier flap in the closed position being cooperative with the continuous circumferential sealing region and forming a seal therewith, and the barrier flap in the open position conforming at least partially to the inner surface of the neck so as to allow substantially unhindered flow of the liquid from the container, the barrier flap being releasable from the resistance stop by squeezing the neck in a direction substantially perpendicular to a line connecting the hinged attachment and the resistance stop, thereby arcing the barrier flap, moving the resistance stop away from the barrier flap, and freeing the barrier flap to pivot to the open position, the hinged attachment being configured so as to resist detachment from the neck when the neck is distorted due to squeezing.

2. The apparatus of claim 1, wherein the hinged attachment applies an opening force to the barrier flap that tends to hingedly pivot the barrier flap from the closed position to the open position.

3. The apparatus of claim 1, wherein the barrier flap can be released from the resistance stop by squeezing the body of the container to increase fluid pressure against the barrier flap.

4. The apparatus of claim 1, wherein the neck is one of substantially round and substantially oval.

5. The apparatus of claim 1, wherein the continuous circumferential sealing region includes a continuous circumferential sealing ridge.

6. The apparatus of claim 1, wherein the barrier flap in the open position is conformed at least partially to the inner surface of the rounded neck by arcing of the barrier flap due to pressing of the barrier flap against the inner surface by the hinged attachment.

7. The apparatus of claim 1, wherein the barrier flap is substantially flat in the closed position.

8. The apparatus of claim 1, wherein the barrier flap includes a curvature about the line connecting the hinged attachment and the resistance stop, the curvature increasing a rigidity of the barrier flap along the line connecting the hinged attachment and the resistance stop, while encouraging the barrier flap to arc when the neck is squeezed in the direction perpendicular to the line connecting the hinged attachment and the resistance stop, the curvature also enhancing the conforming of the barrier flap to the inner surface of the neck when the barrier flap is in the open position.

9. The apparatus of claim 1, wherein the hinged attachment is a strip of material having an end attached to the barrier flap, an end attached to the inner surface of the neck, and an elastic middle portion that is flexed when the barrier flap is in the closed position.

10. The apparatus of claim 9, wherein the elastic middle portion, when flexed, applies an elastic force to the barrier flap that is able to pivot the barrier flap to the open position when the barrier flap is released from the resistance stop.

11. The apparatus of claim 1, wherein the hinged attachment is formed by a mechanical hinge having an end attached to the barrier flap and an end attached to the inner surface of the neck.

12. The apparatus of claim 11, wherein the mechanical hinge includes a spring configured to apply a force to the barrier flap that is able to pivot the barrier flap to the open position when the barrier flap is released from the resistance stop.

13. The apparatus of claim 1, wherein the barrier flap includes a plurality of longitudinal arcing regions running parallel to the line that connects the hinged attachment to the resistance stop, the longitudinal arcing regions being for facilitating arcing of the barrier flap.

14. The apparatus of claim 13, wherein at least one of the longitudinal arcing regions is of a different material than other regions of the barrier flap.

15. The apparatus of claim 1, wherein the barrier flap includes a plurality of longitudinal grooves running parallel to the line that connects the hinged attachment to the resistance stop the longitudinal grooves being for facilitating arcing of the barrier flap.

16. The apparatus of claim 1, further comprising a protective covering attached to the barrier flap and able to prevent fragmentation of the barrier flap due to structural failure.

17. The apparatus of claim 1, further comprising a guard, disposed between the neck and the mouth of the container, and shaped so as to prevent the barrier flap from moving with the fluid out of the container in the event that the barrier flap becomes detached from the inner surface of the neck of the container.

18. The apparatus of claim 17, wherein the guard spans the mouth of the container.

19. The apparatus of claim 1, wherein the mouth is narrow with respect to the neck of the container, so as to prevent the barrier flap from moving with the fluid out of the container in the event that the barrier flap becomes detached from the inner surface of the neck of the container.

* * * * *